US012031391B2

(12) United States Patent
Layden

(10) Patent No.: US 12,031,391 B2
(45) Date of Patent: Jul. 9, 2024

(54) COIL STRUCTURE

(71) Applicant: LYNCHPIN TECHNOLOGIES (CAYMAN) LTD, Grand Cayman (KY)

(72) Inventor: Reginald Waye Layden, Seven Mile Beach (KY)

(73) Assignee: Lynchpin Technologies (Cayman) LTD, Grand Cayman (KY)

( * ) Notice: Subject to any disclaimer, the term of this patent is extended or adjusted under 35 U.S.C. 154(b) by 0 days.

(21) Appl. No.: 17/450,995

(22) Filed: Oct. 14, 2021

(65) Prior Publication Data

US 2022/0127915 A1 Apr. 28, 2022

Related U.S. Application Data

(60) Provisional application No. 63/091,887, filed on Oct. 14, 2020.

(51) Int. Cl.
*E21B 15/00* (2006.01)
*E21B 19/00* (2006.01)
*E21B 19/22* (2006.01)

(52) U.S. Cl.
CPC ..... *E21B 19/004* (2013.01); *E21B 19/22* (2013.01); *E21B 15/00* (2013.01)

(58) Field of Classification Search
CPC ..... E21B 15/00; E21B 19/004; E21B 19/22
See application file for complete search history.

(56) References Cited

U.S. PATENT DOCUMENTS 6,000,480 A * 12/1999 Eik ..... E21B 19/143 405/195.1
6,431,286 B1 * 8/2002 Andreychuk ..... E21B 19/22 166/77.2
6,554,075 B2 * 4/2003 Fikes ..... E21B 15/02 166/85.1
7,404,443 B2 * 7/2008 Patton ..... E21B 19/002 166/77.2
7,784,546 B2 * 8/2010 Patton ..... E21B 19/22 405/196
8,191,636 B2 * 6/2012 Coles ..... E21B 19/006 166/250.01

(Continued)

FOREIGN PATENT DOCUMENTS

WO 0034620 A1 6/2000
WO WO-2011135541 A2 * 11/2011 ..... E21B 15/003

OTHER PUBLICATIONS

International Search Report and Written Opinion dated Feb. 4, 2022 for related International Patent Application No. PCT/US2021/071896.

*Primary Examiner* — Matthew R Buck
(74) *Attorney, Agent, or Firm* — Ramey LLP; Jacob B. Henry

(57) ABSTRACT

A coil structure unit comprises a base and a tower structure, the tower structure comprises a plurality of intermediate units. The length of each of the plurality of intermediate sections can be about 50 feet. The length allows to utilize a manipulator that allows equipment such as lubricators and blowout preventers to be integral to the loads which will eliminate much of the rig up time and complication as well as having much more flexibility in operations to take the items on and off hole.

10 Claims, 39 Drawing Sheets

(56) References Cited

U.S. PATENT DOCUMENTS

| | | | | |
|---|---|---|---|---|
| 8,511,385 | B2 * | 8/2013 | Sorenson | E21B 15/003 166/360 |
| 8,555,974 | B2 * | 10/2013 | Moncus | E21B 19/22 166/77.2 |
| 2007/0125551 | A1 * | 6/2007 | Havinga | E21B 15/00 166/77.2 |
| 2012/0318530 | A1 * | 12/2012 | Wollum | E21B 19/22 166/85.4 |
| 2014/0000867 | A1 | 1/2014 | Andreychuk et al. | |
| 2015/0315861 | A1 * | 11/2015 | Zachariasen | E21B 15/003 166/77.2 |
| 2018/0016855 | A1 * | 1/2018 | Lee | E21B 7/024 |
| 2018/0274311 | A1 * | 9/2018 | Zsolt | E21B 19/22 |
| 2018/0313467 | A1 * | 11/2018 | Bingham | F16L 1/23 |
| 2019/0063168 | A1 * | 2/2019 | Reddy | E21B 15/003 |

* cited by examiner

COIL STRUCTURE

FIELD

The disclosure relates generally to a coil structure unit. The disclosure relates specifically to a coiled tubing drilling and service unit and method.

BACKGROUND

Coil structure units provide support structure and enables coiled tubing/wireline (CT/WL) equipment rig-up, running operational tools. Typically, this involves installation of a blowout preventer (BOP), lubricator system, handling of an injector head and the change of bottom hole assemblies (BHAs). Conventional units are put together by cranes with 9' (+/−) sections. Due to this design, the assembly of conventional units takes a very long time. When each 9' section is installed, the well control equipment needs to be built to that point as well before continuing to build the next section of the structure unit. Because of this, wellhead operations, such as pulling back pressure valves, have to be done before the crew can assemble past the first few sections. This causes considerable delay.

The shortcomings of conventional units is that they are entirely crane dependent. Because of their design, the unit has many small pieces that need to be assembled in a certain order with other components. The process is extremely time consuming. The dependence on the crane for operation makes all processes take longer due to all of the added steps to the processes. In addition, there are extra costs associated with the continuous rental of a large crane.

It would be advantageous to have a coil structure unit that is not entirely crane-dependent and does not require that the well control equipment be built simultaneously.

SUMMARY

An embodiment of the disclosure is a coil tubing tower structure, comprising a base and a tower structure, wherein the tower structure comprises a plurality of intermediate units. In another embodiment, the length of each of the plurality of intermediate units is about 50 feet. In another embodiment, a well control equipment is secured at the top of each intermediate unit. In another embodiment, the well control equipment is secured at the top of each intermediate unit by a manipulating device. In another embodiment, the manipulating device has an ability of holding the well control equipment. In another embodiment, the manipulating device has an ability of raising and lowering the well control equipment. In another embodiment, the manipulating device has an ability taking the well control equipment overhole or offhole. In another embodiment, the structure further comprises an injector. In another embodiment, the injector is operated by an injector manipulating device. In another embodiment, the injector manipulating device has an ability to pick up, articulate, move the injector. In another embodiment, the structure further comprises a telescoping hoisting structure. In another embodiment, the telescoping hoisting structure has the ability to move to multiple positions.

An embodiment of the disclosure is a process of servicing an oil well utilizing the coil structure unit above.

An embodiment of the disclosure is a process of using a telescoping equipment device comprising picking up a bottom hole assembly using one or more sections to a height suitable to place the bottom hole assembly in a wellbore, wherein transport modularly remains in the sections. In another embodiment, the sections are about 50' in height. In another embodiment, the height is at least 200'. In another embodiment, the bottom hole assembly is about 100' in height. In another embodiment, the bottom hole assembly is stored on the tower. In another embodiment, the telescoping equipment device stores the bottom hole assembly in a mouse hole.

An embodiment of the disclosure is a process of picking up a bottom hole assembly comprising utilizing a drive mechanism. In another embodiment, the bottom hole assembly is picked up from rest to hole center. In another embodiment, the bottom hole assembly is picked up from storage in a mouse hole.

An embodiment of the disclosure is a process of assembling an equipment hoisting device comprising combining multiple sections of a tubular in a vertical manner. In another embodiment, there is a connection point between two sections of a tubular.

An embodiment of the disclosure a cartridge-style reel system comprising placing shipping reels in a cartridge holder; wherein the cartridge holder is capable of being installed in the rig.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

Figure 1:
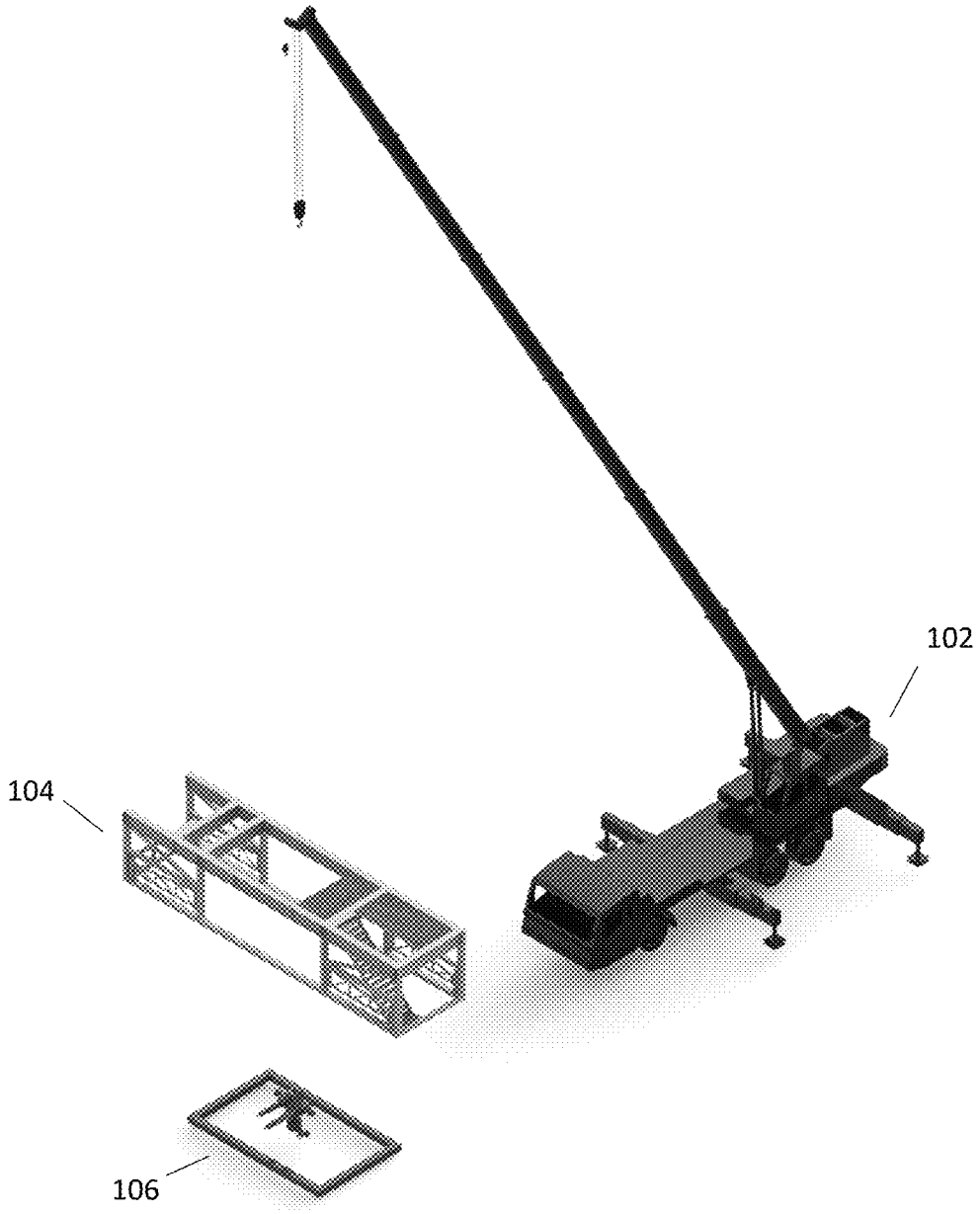
FIG. 1 shows a perspective view of a process of assembling a coiled tubing tower in accordance with the disclosure.

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary $11^{th}$ Edition.

The present disclosure encompasses a new, more efficient assembly process and design of coil structure units. The coil structure units have the ability to operate cranelessly once assembled, resulting in much faster, cheaper, and safer operating processes such as tool deployment and undeployment, coil stabbing and unstabbing, as well as an enhanced ability to maintain and repair the injector and associated equipment. The new design also cuts the number of loads and connections in half compared to conventional units, including but not limited to, BOPs, lubricators, and iron. This creates a much cheaper and faster rig in. The design also integrates the applicable equipment associated with its section of the unit. That is, the bottom section of the device has the BOPs integral, thus removing the need to install or remove as in conventional units.

Some of the embodiments disclosed herein relate to a coil structure unit, including a base and a tower structure, with the tower structure comprising a plurality of intermediate sections. In an embodiment, the length of each of the plurality of intermediate sections is 50 feet. In an embodiment, well control equipment is secured at the top of each intermediate section. In an embodiment, the well control equipment is secured at the top of each intermediate section by a manipulating device, with the manipulating device having an ability of holding the equipment as well as raising or lowering the equipment, as well as taking overhole or offhole.

In an embodiment, the coil structure unit further comprises an injector. In an embodiment, the injector is operated by an injector manipulating device. The injector manipulating device has the ability to pick up, articulate, and take the injector to the top or bottom of the coil unit structure as well as on and off hole.

In an embodiment, the coil structure unit further comprises a telescoping hoisting structure and the telescoping hoisting structure has the ability to move to multiple positions in the coil structure unit.

Figure 2:
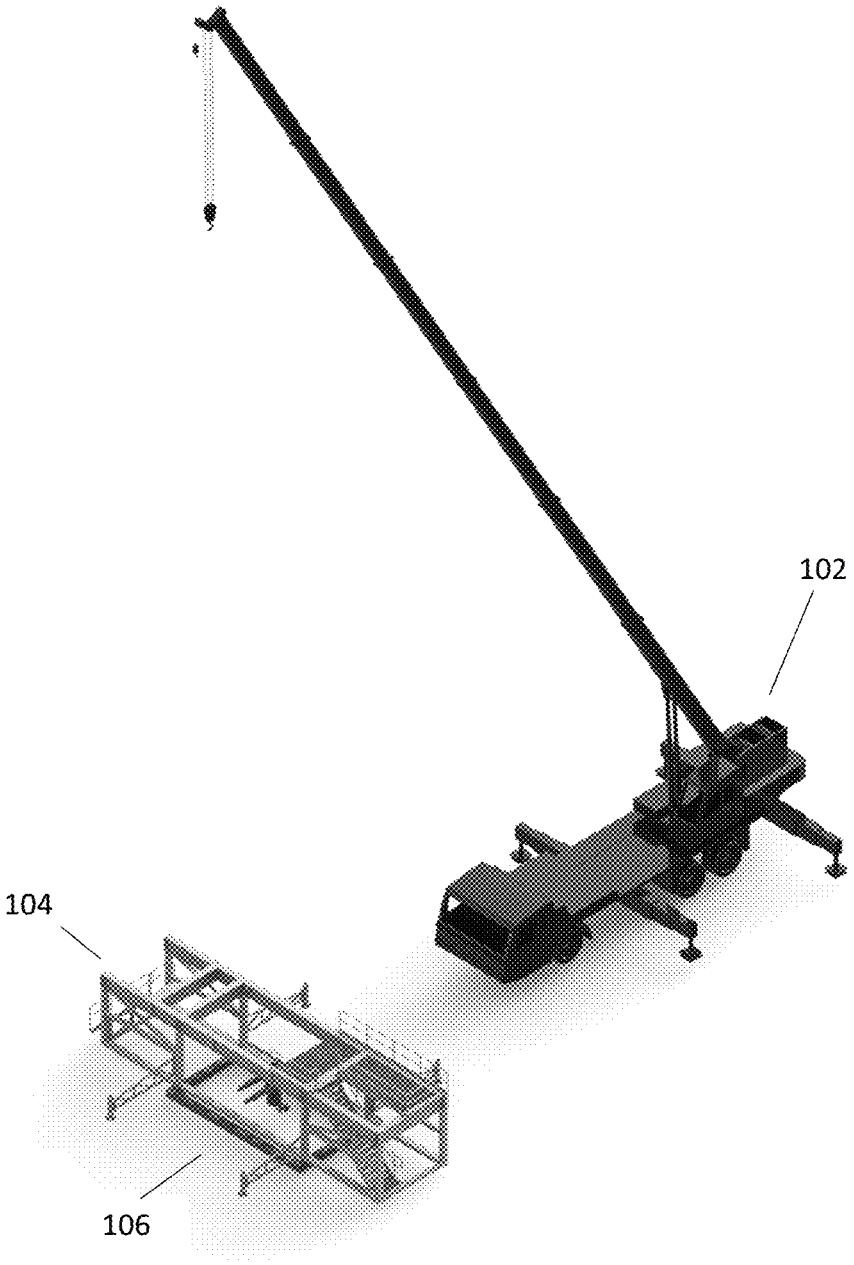
FIG. 2 shows a perspective view of a process of assembling a coiled tubing tower in accordance with the described embodiments.
Figure 3:
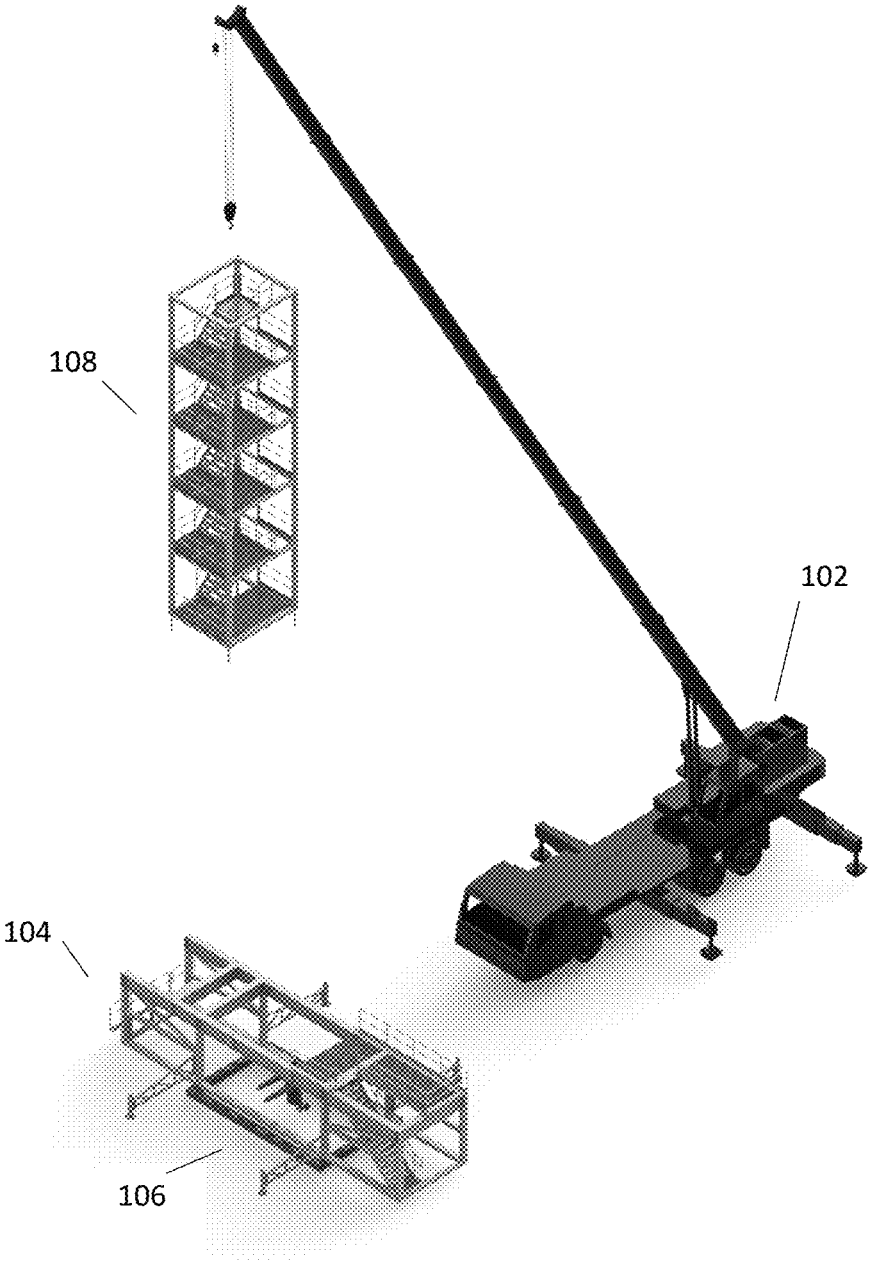
FIG. 3 shows a perspective view of a process of assembling a coiled tubing tower in accordance with the disclosure.
Figure 4:
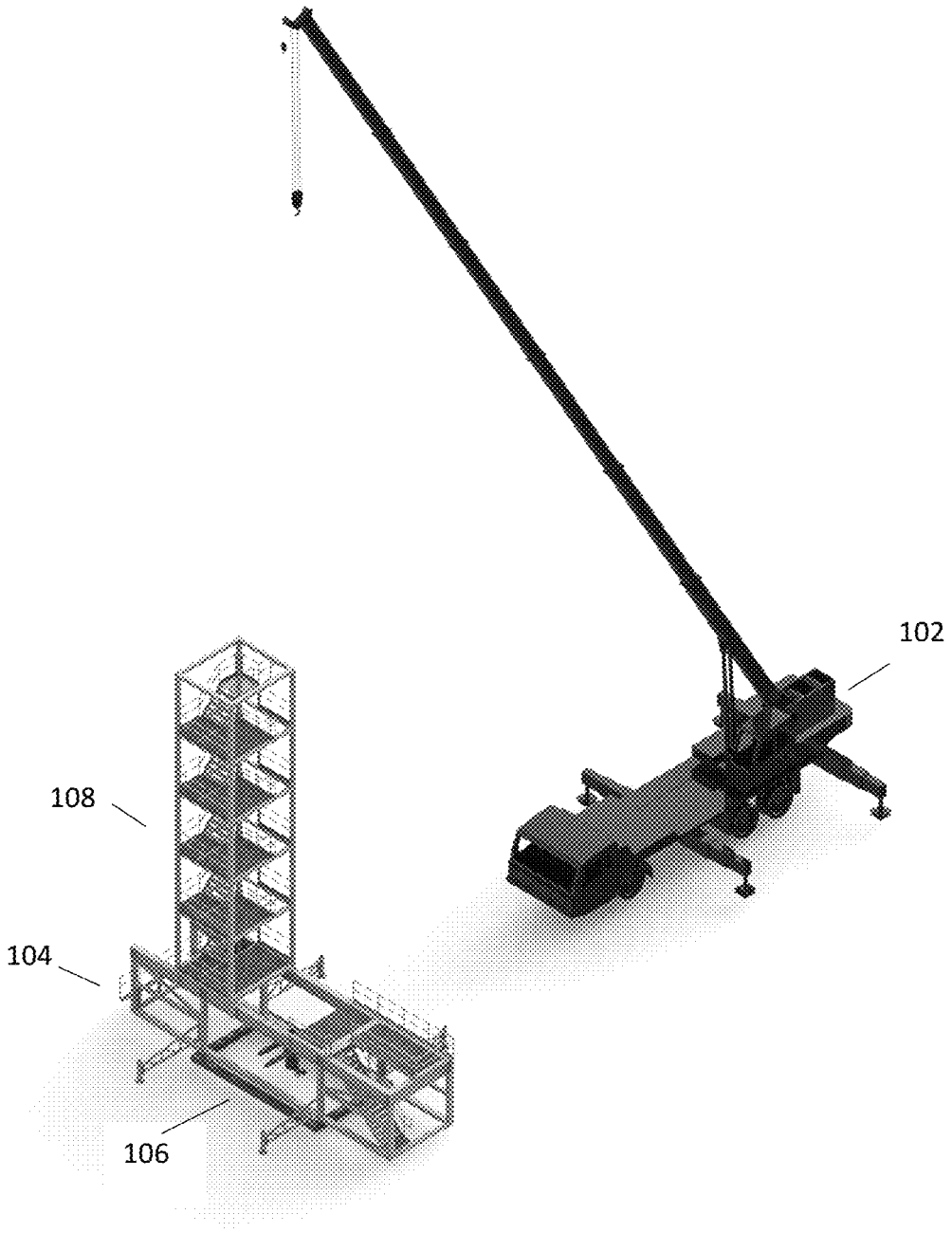
FIG. 4 shows a perspective view of a process of assembling a coiled tubing tower in accordance with the disclosure.
Figure 5:
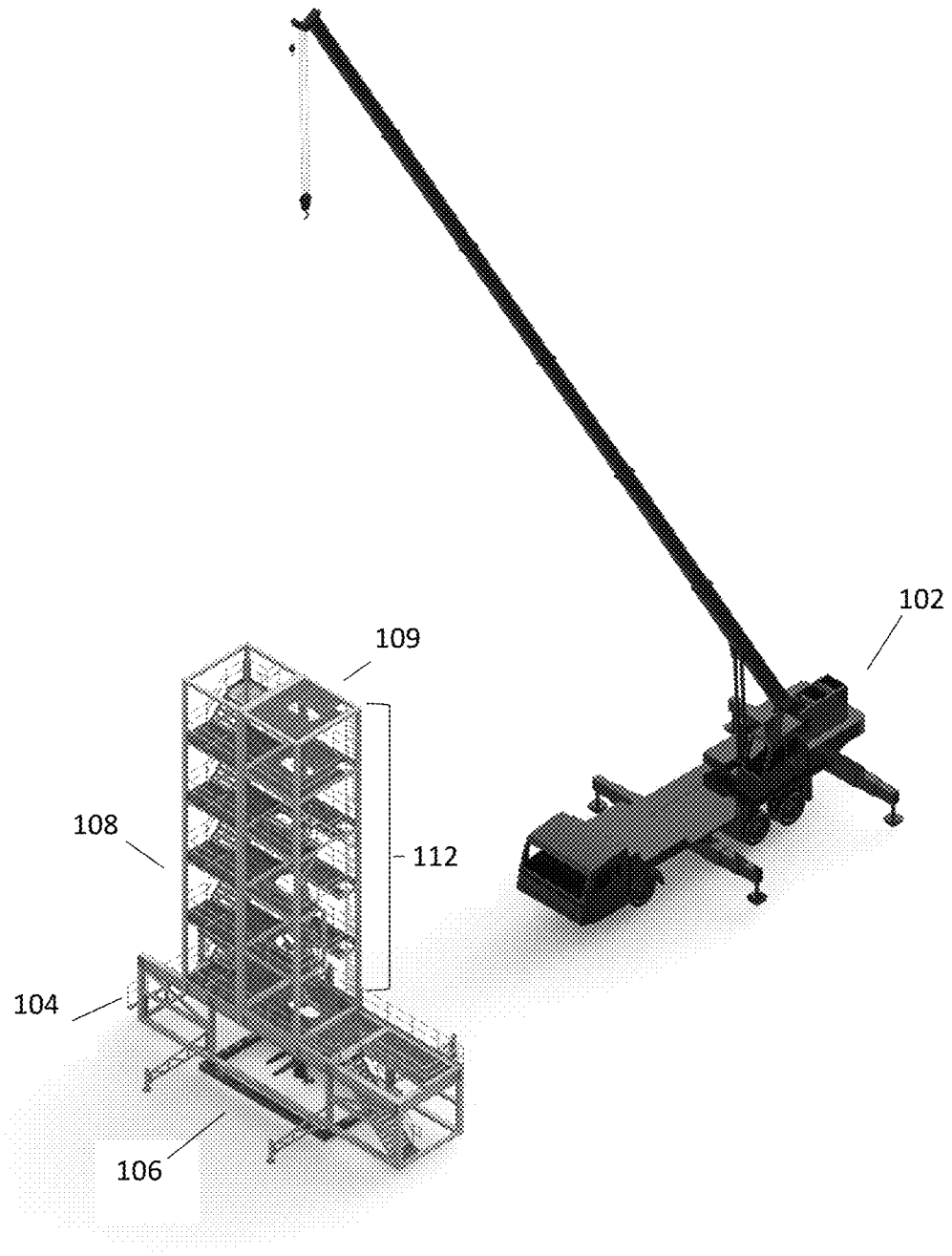
FIG. 5 shows a perspective view of a process of assembling a coiled tubing tower in accordance with the disclosure.
Figure 6:
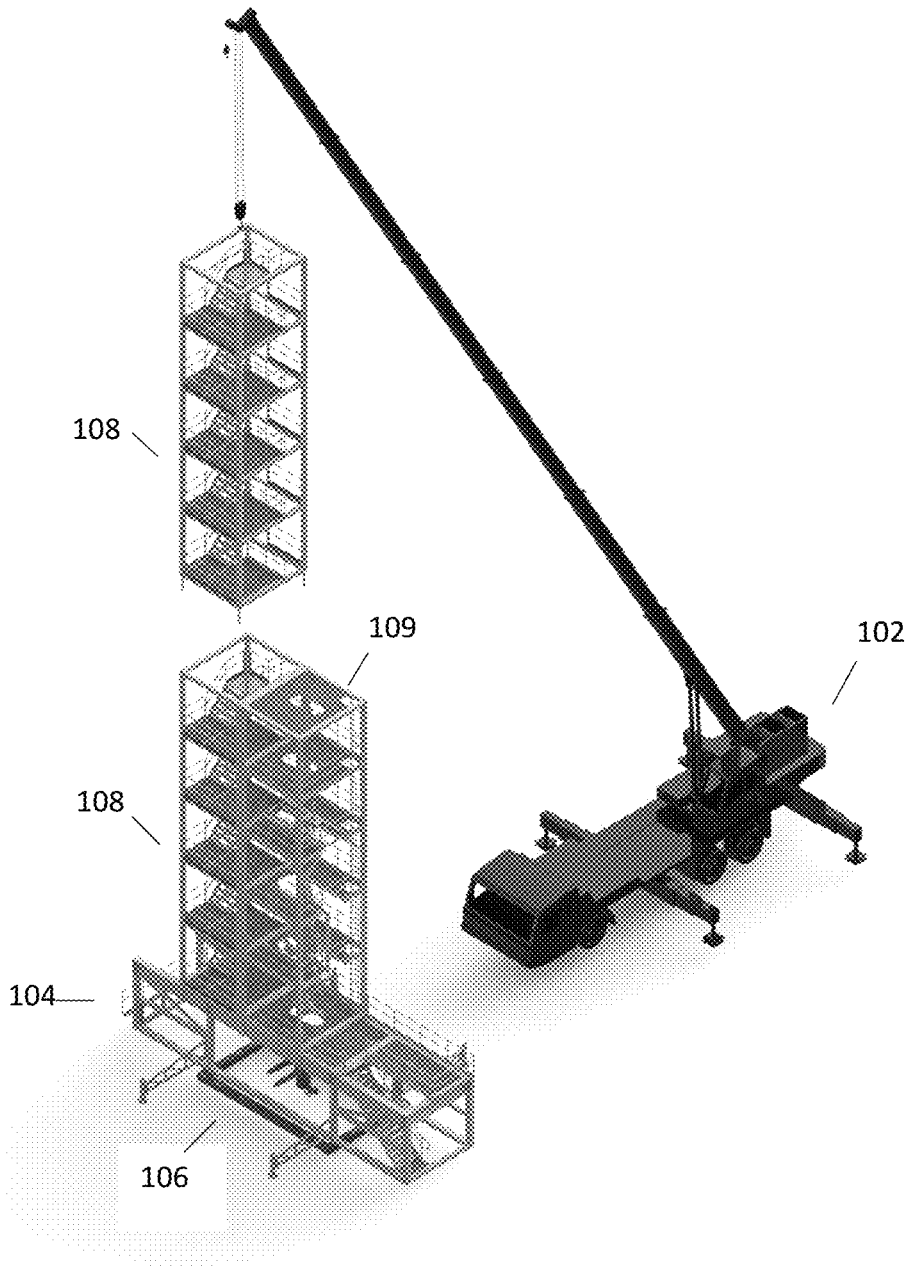
FIG. 6 shows a perspective view of a process of assembling a coiled tubing tower in accordance with the disclosure.
Figure 7:
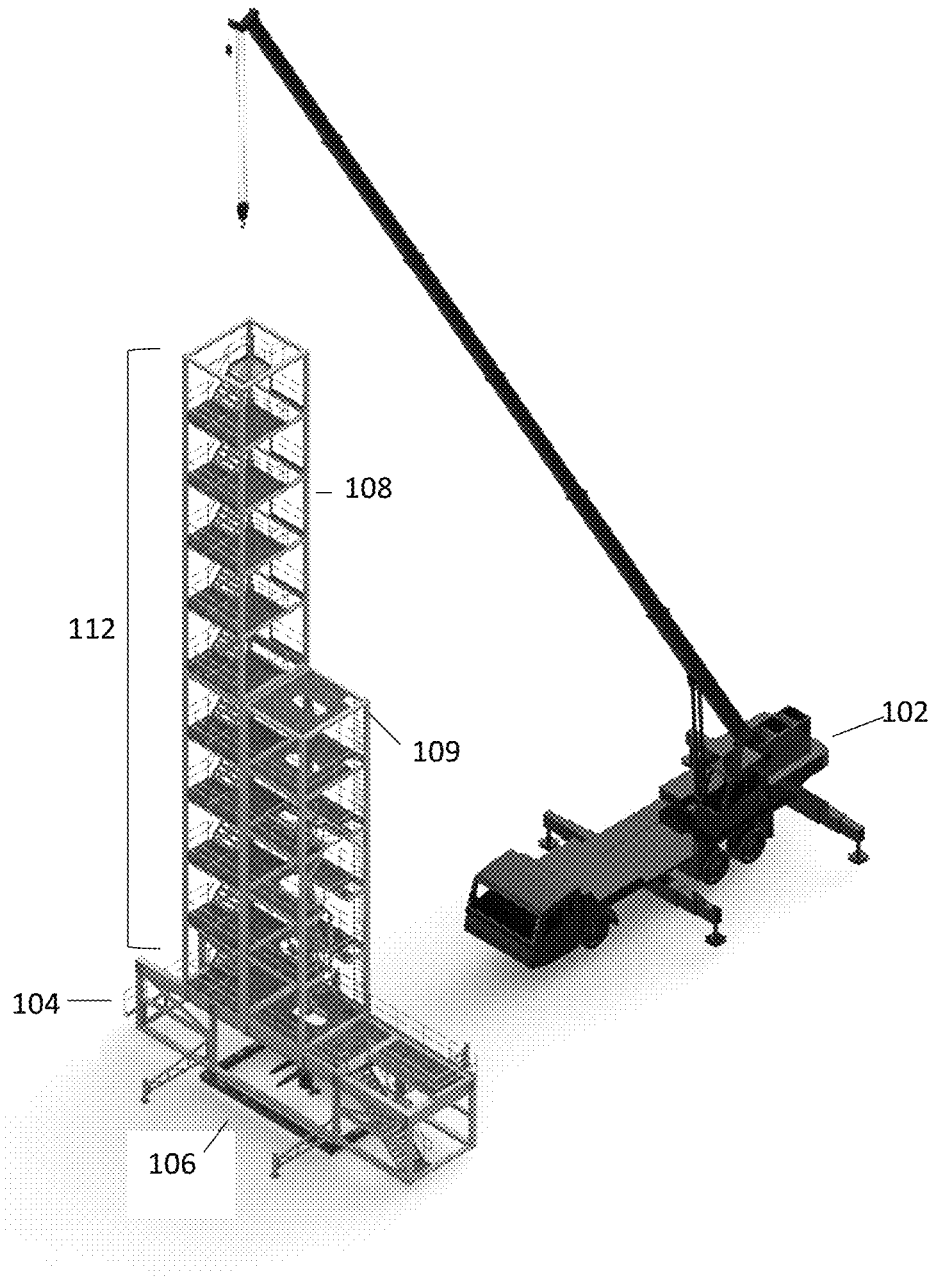
FIG. 7 shows a perspective view of a process of assembling a coiled tubing tower in accordance with the disclosure.
Figure 8:
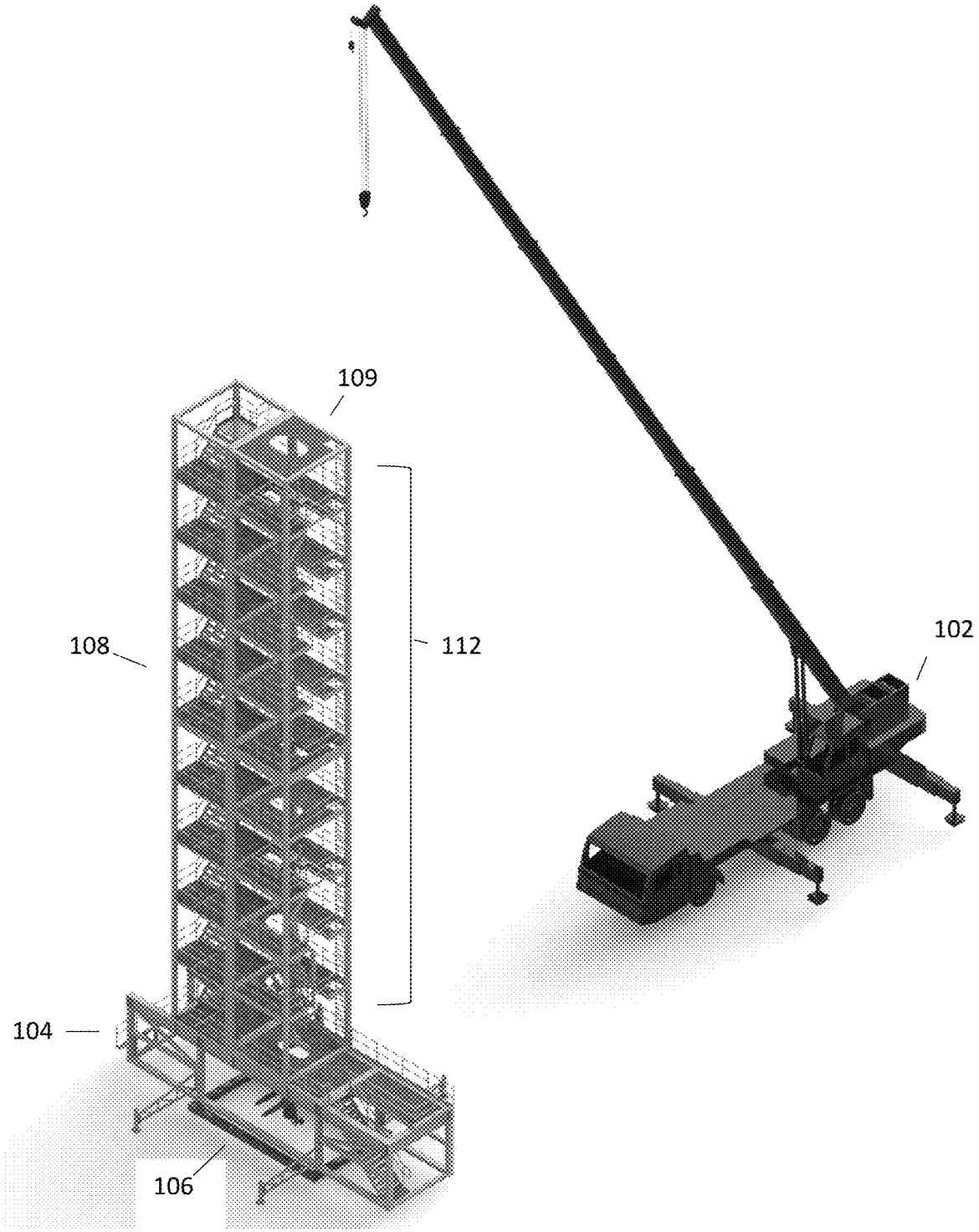
FIG. 8 shows a perspective view of a process of assembling a coiled tubing tower in accordance with the disclosure.
Figure 9:
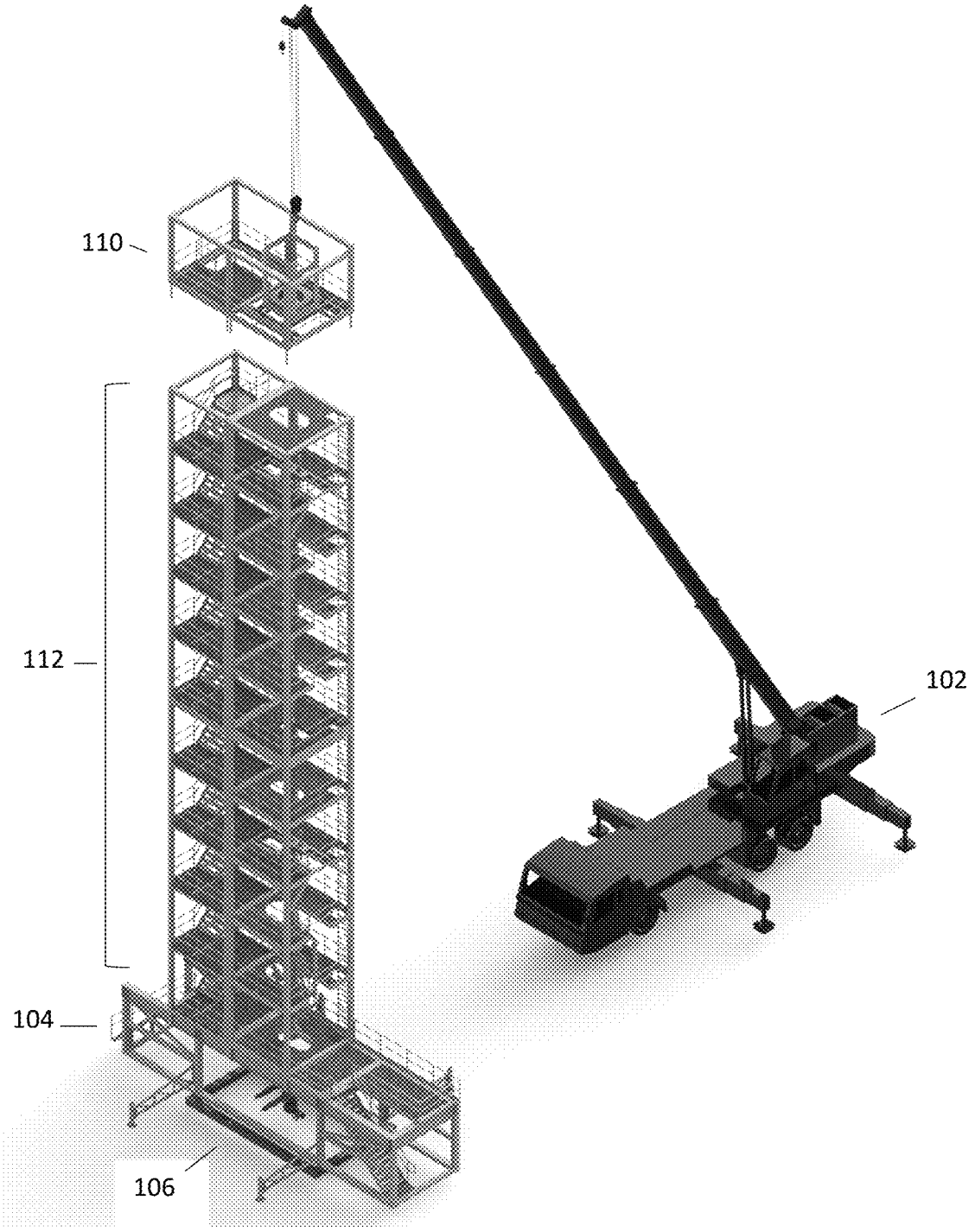
FIG. 9 shows a perspective view of a process of assembling a coiled tubing tower in accordance with the disclosure.
Figure 10:
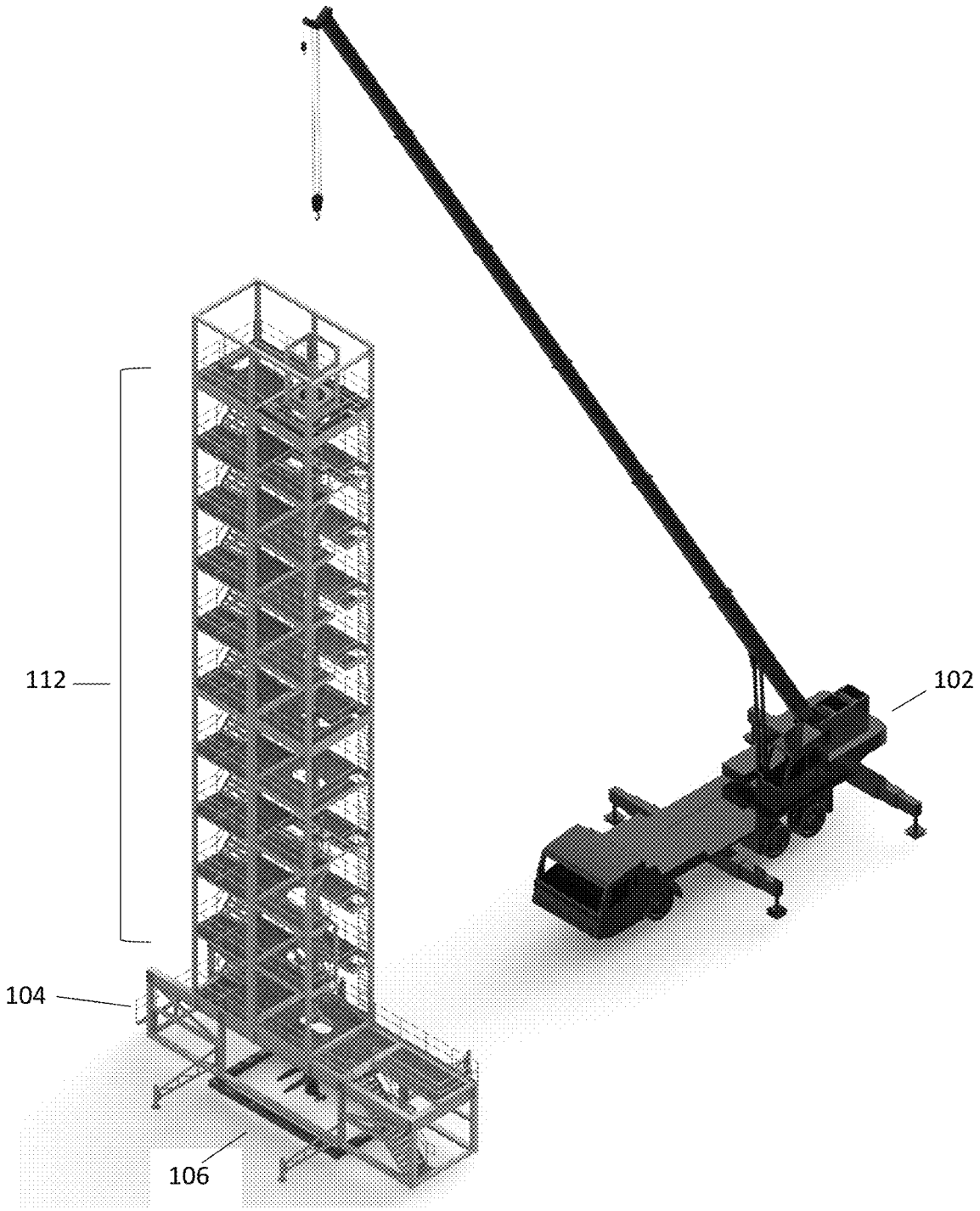
FIG. 10 shows a perspective view of a process of assembling a coiled tubing tower in accordance with the disclosure.
Figure 11:
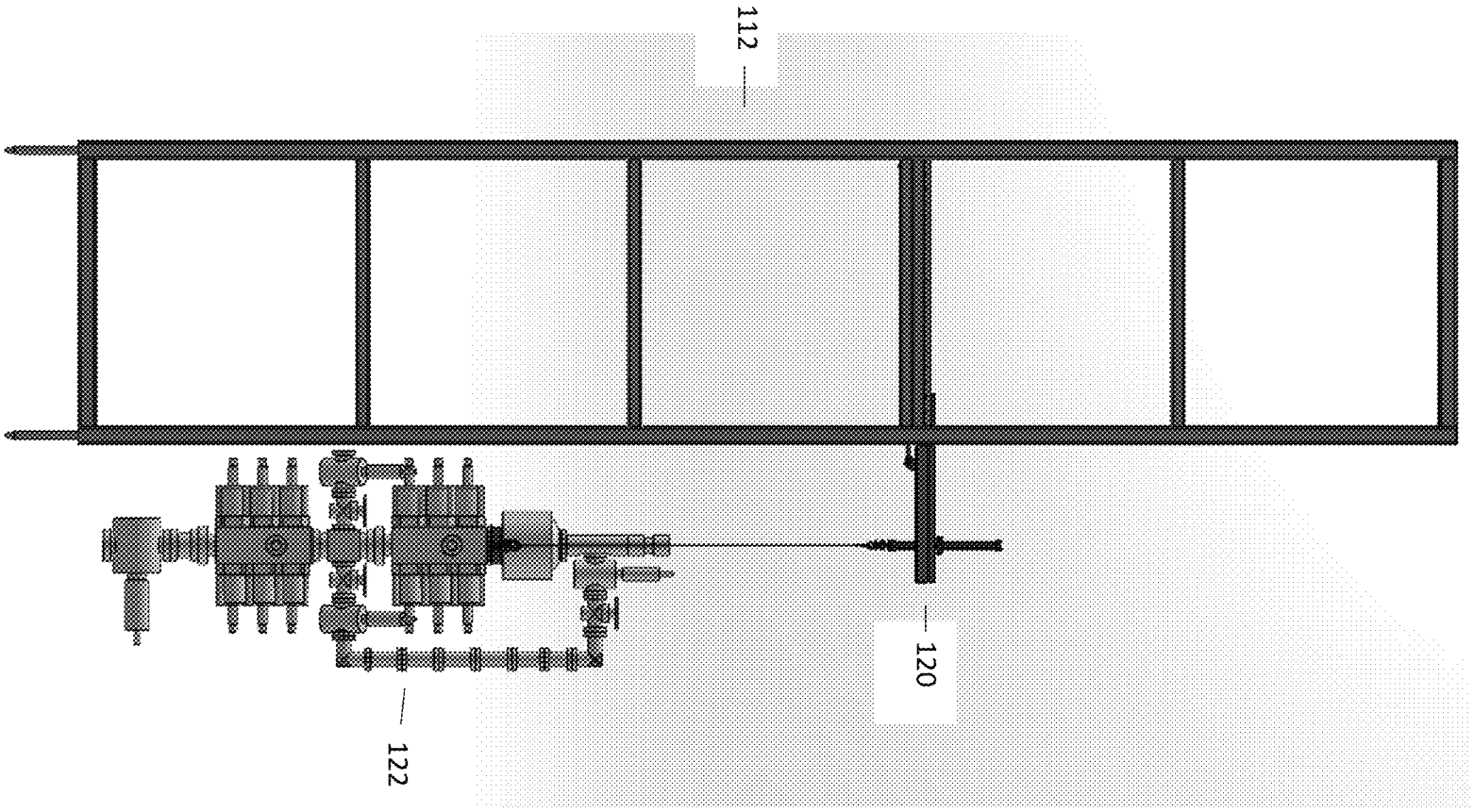
FIG. 11 shows a side view of a process of assembling an integrated equipment manipulating device.

In an embodiment, the coil structure unit can be used to service an oil well. FIGS. 1-10 show a process of assembling a coiled tubing tower. In an embodiment, the tower comprises the base frame, onto which various intermediate segments are fitted in order to achieve variable heights, and the lift frame for holding the injector. In an embodiment, the coiled tubing tower is comprised of steel. FIG. 1 shows a crane 102 being used to place a base structure 104 on a well 106. FIG. 2 shows a crane 102 having placed a base structure 104 over a well 106. FIG. 3 shows a crane 102 being used to place an intermediate unit a 108 on a base structure 104. The base structure 104 is over a well 106. FIG. 4 shows a crane 102 having placed an intermediate unit a 108 on a base structure 104. FIG. 5 shows a crane 102 having placed intermediate unit a 108 and intermediate unit b 109 on a base structure 104. Intermediate units a and intermediate units b form a tower structure 112. FIG. 6 shows a crane 102 placing intermediate unit a 108 on a tower structure 112. FIG. 7 shows a crane 102 having placed an intermediate unit a 108 on a tower structure 112. FIG. 8 shows a crane 102 having placed intermediate unit b 109 on a tower structure 112. FIG. 9 shows a crane 102 placing intermediate unit a 108 on a tower structure 112. FIG. 10 shows a crane 102 placing top unit 110 on a tower structure 112. FIG. 11 shows a crane 102 having placed a top unit 110 on a tower structure 112.

In an embodiment, units are assembled perpendicularly, allowing the section to be 50' long. Conventional coil structure units can have sections of approximately 9'. The longer length of the sections permits utilization of a manipulator that allows equipment, including but not limited to, lubricators and BOPs to be integral to these loads. This eliminates much of the rig up time and complications. It also provides more flexibility in operations to take these items on and off hole. In an embodiment, the tool-elevating aspect of the design allows for the craneless pick up and lay down of downhole tools upward of 100' in length. Conventional units cannot accomplish this as they are forced to pick tools up piece by piece, resulting in a complicated and time consuming process.

Figure 12:
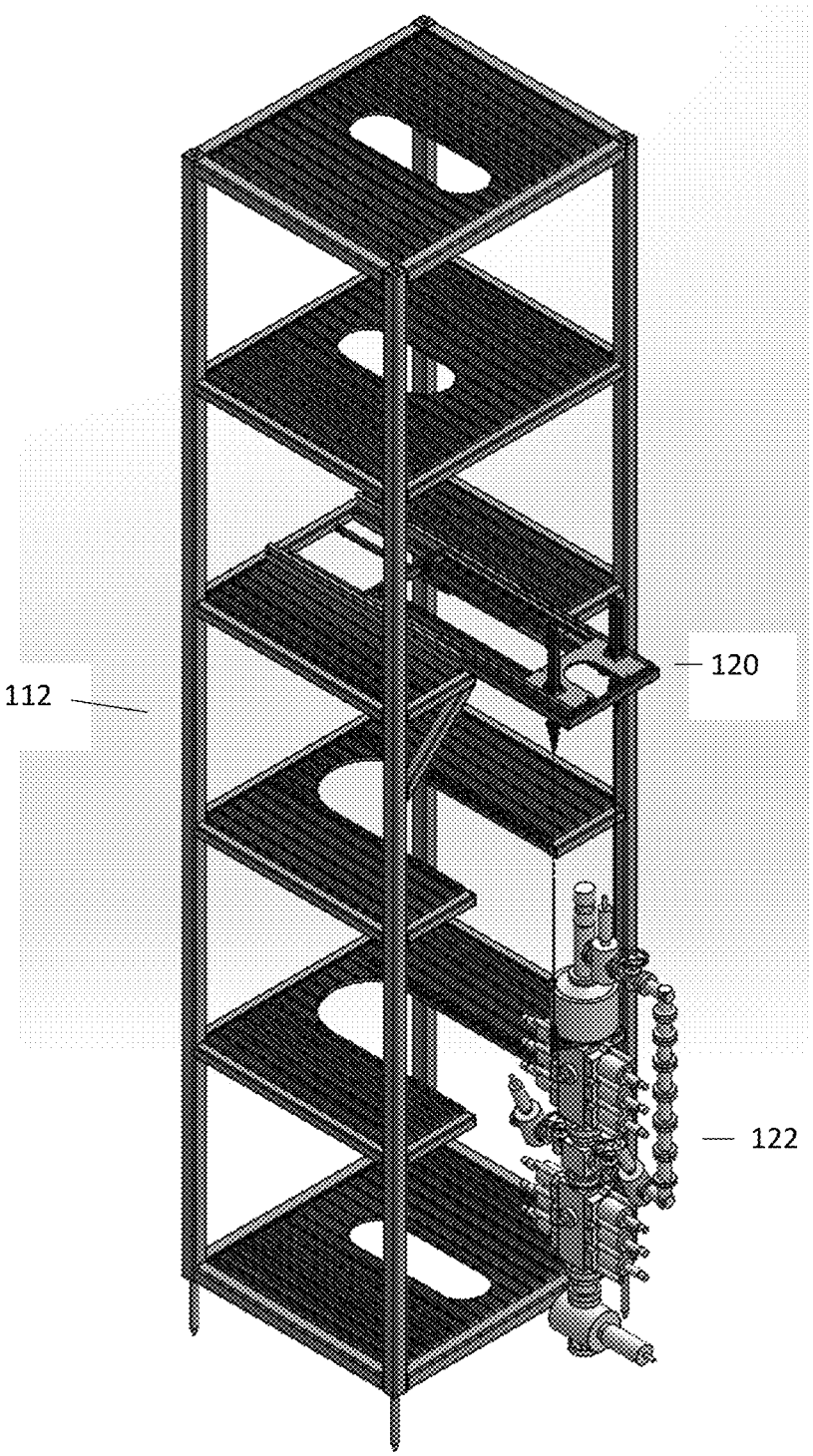
FIG. 12 shows a perspective view of a process of assembling an integrated equipment manipulating device.
Figure 13:
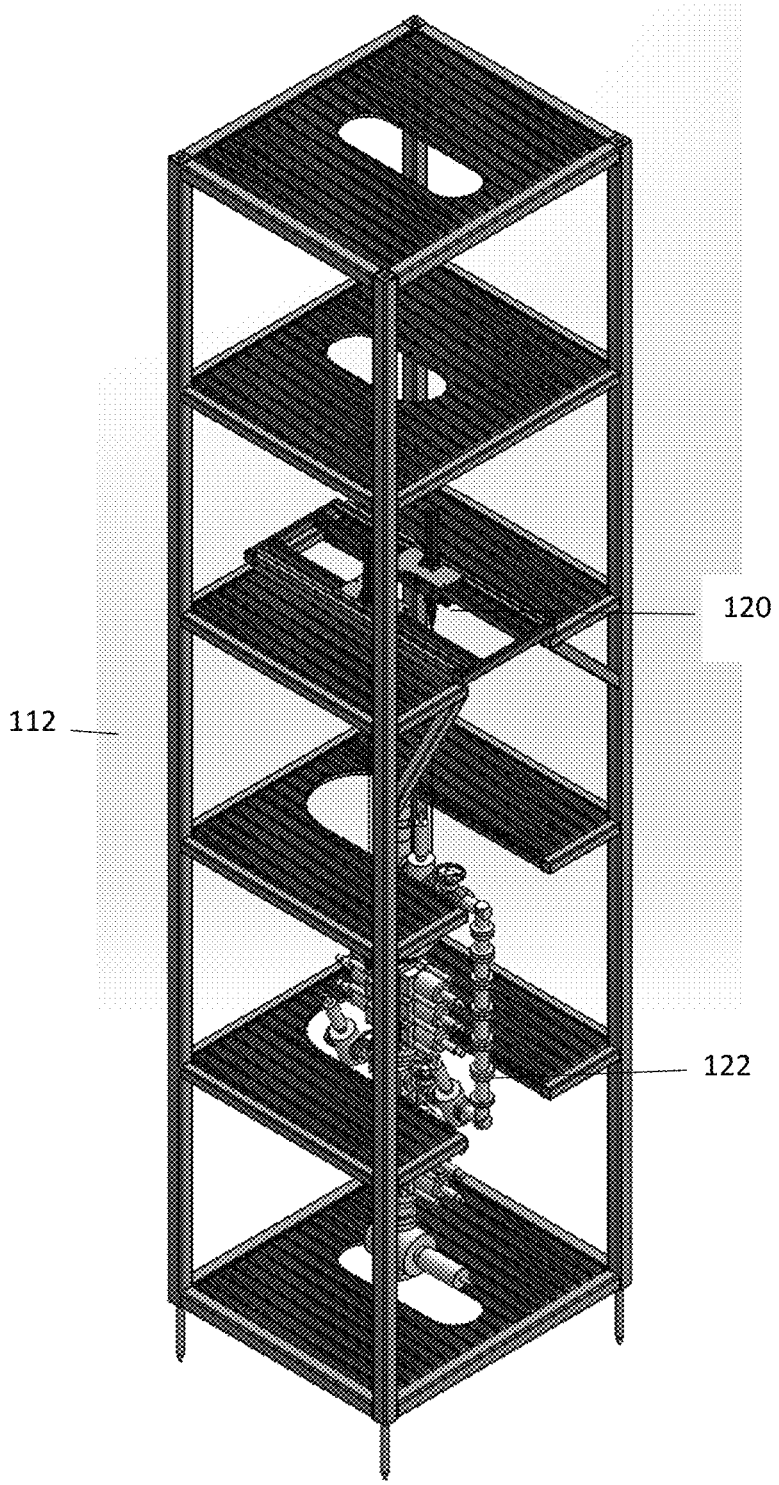
FIG. 13 shows a perspective view of a process of assembling an integrated equipment manipulating device.

FIGS. 11-13 show a process of assembling an integrated equipment manipulating device. FIG. 11 shows a side view of a tower structure 112, an equipment manipulation device 120, and pressure control equipment 122. FIG. 12 shows a perspective view of a tower structure 112, an equipment manipulation device 120, and pressure control equipment 122. FIG. 13 shows a perspective view of a tower structure 112, an equipment manipulation device 120, and pressure control equipment 122 (inside the tower structure 112).

Figure 14:
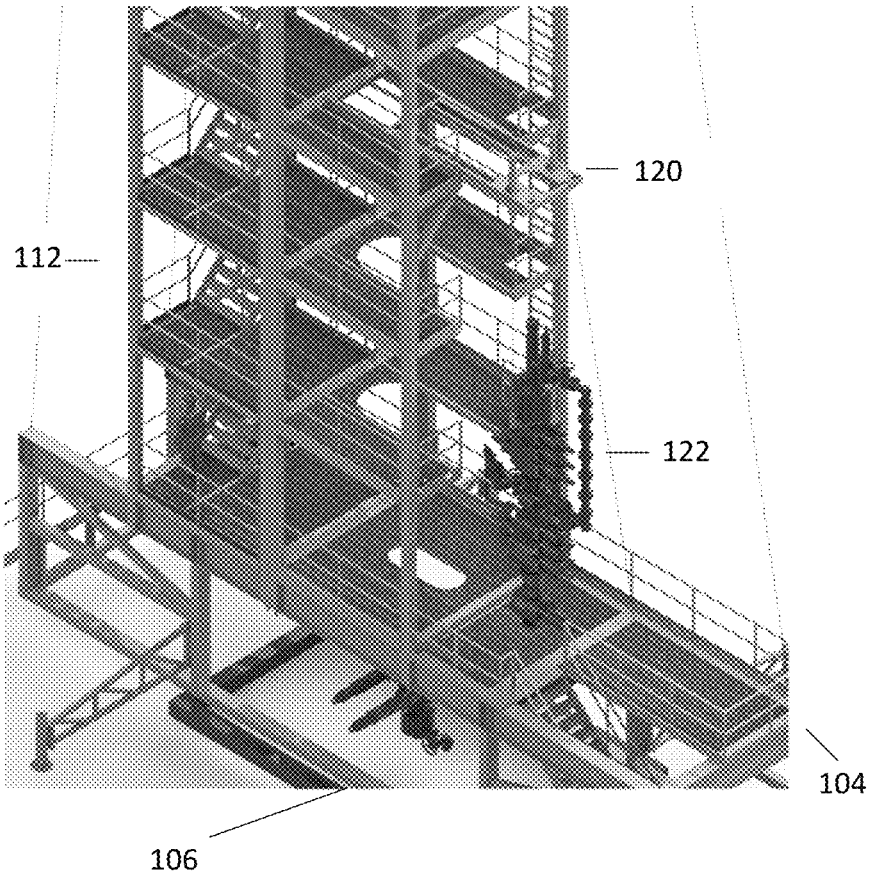
FIG. 14 shows a perspective view of a process of assembling integrated equipment into loads.
Figure 15:
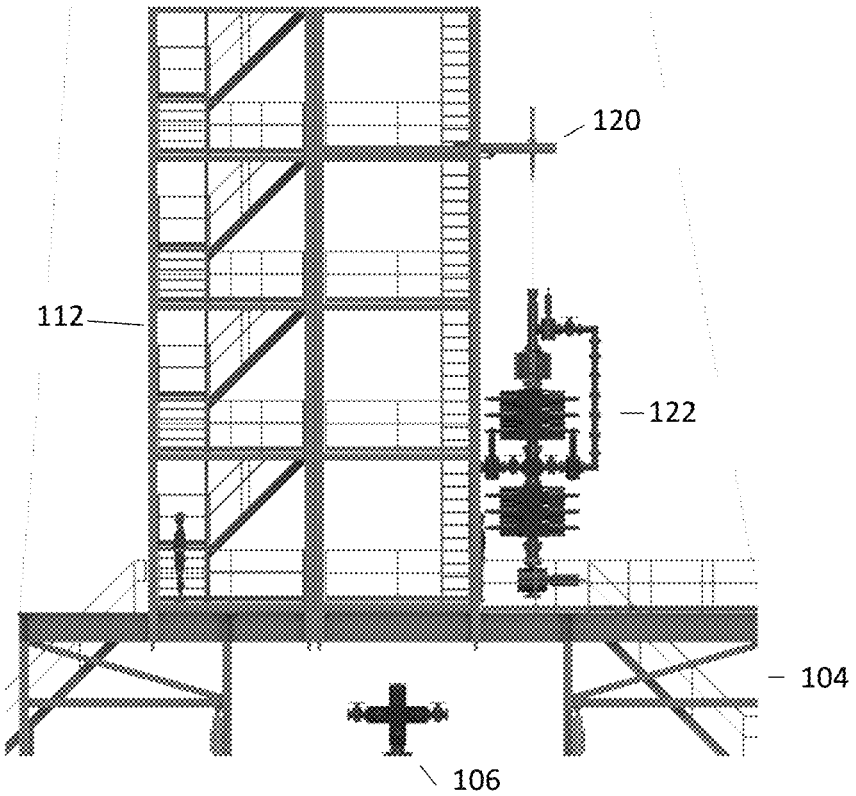
FIG. 15 shows a side view a process of assembling integrated equipment into loads.
Figure 16:
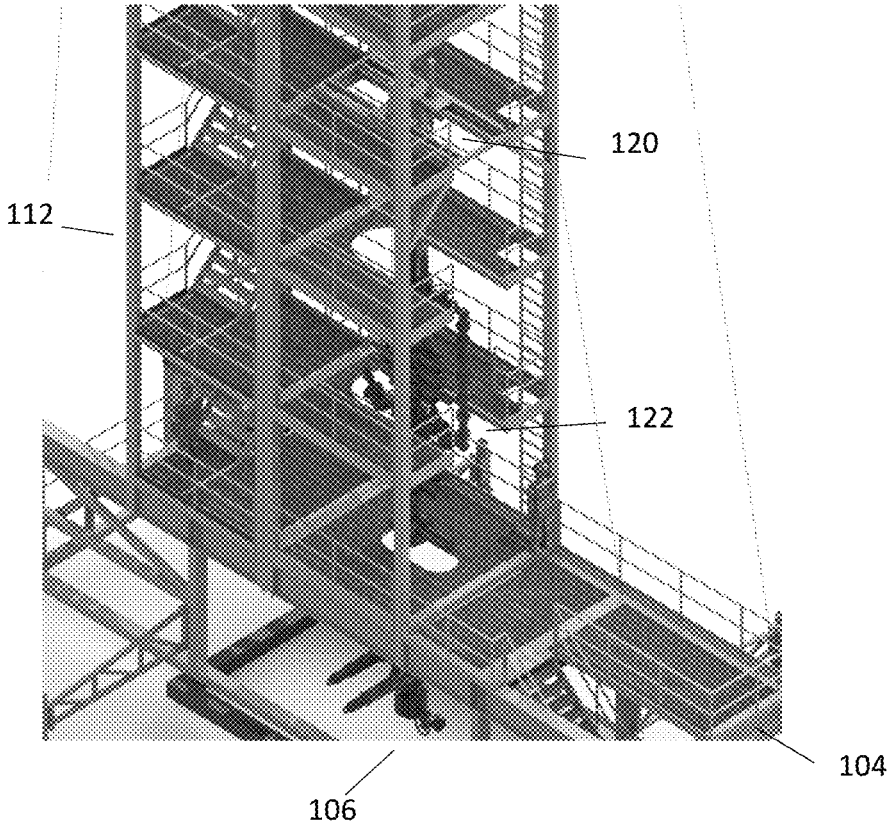
FIG. 16 shows a perspective view of a process of assembling integrated equipment into loads.

FIGS. 14-16 show a process of assembling integrated equipment into loads. FIG. 14 shows a perspective view of a tower structure 112, an equipment manipulation device 120, and pressure control equipment 122. FIG. 15 shows a side view of a tower structure 112, an equipment manipulation device 120, and pressure control equipment 122. FIG. 16 shows a perspective view of a tower structure 112, an equipment manipulation device 120, and pressure control equipment 122 (inside the tower structure 112).

Figure 17:
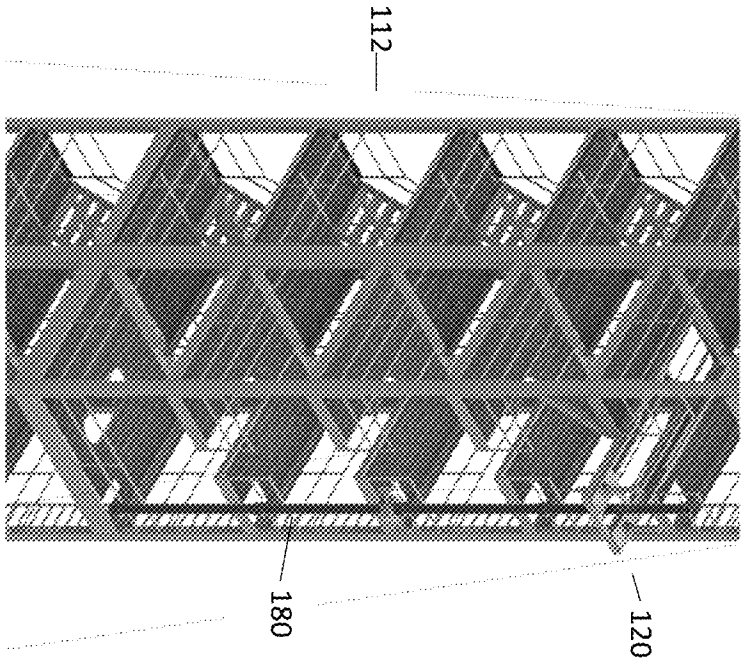
FIG. 17 shows a perspective view of a process of assembling a wireline.
Figure 18:
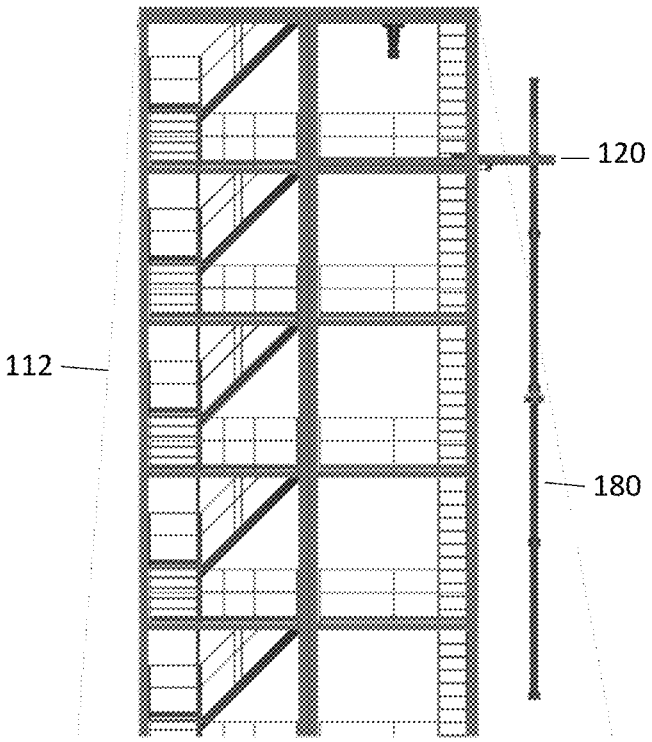
FIG. 18 shows a side view of a process of assembling a wireline.

FIGS. 17-18 show a process of assembling a wireline. FIG. 17 shows a perspective view of a tower structure 112 and an equipment manipulation device 120. FIG. 18 shows a tower structure 112 and wireline 180.

Thus, it can be seen that the advantage of 50' sections are that the well control equipment can be incorporated into these loads. This provides assembly in 2 pieces as opposed to 13 pieces in conventional units. The equipment is also secured at the top of each section by a manipulating device designed to hold the equipment as well as raise or lower and take overhole or offhole. This flexibility is critical in the efficient assembly and operation of the tower, eliminating days from the process. It also allows for much easier maintenance and repair of all these items. In an embodiment, the equipment manipulating device is comprised of steel.

Figure 19:
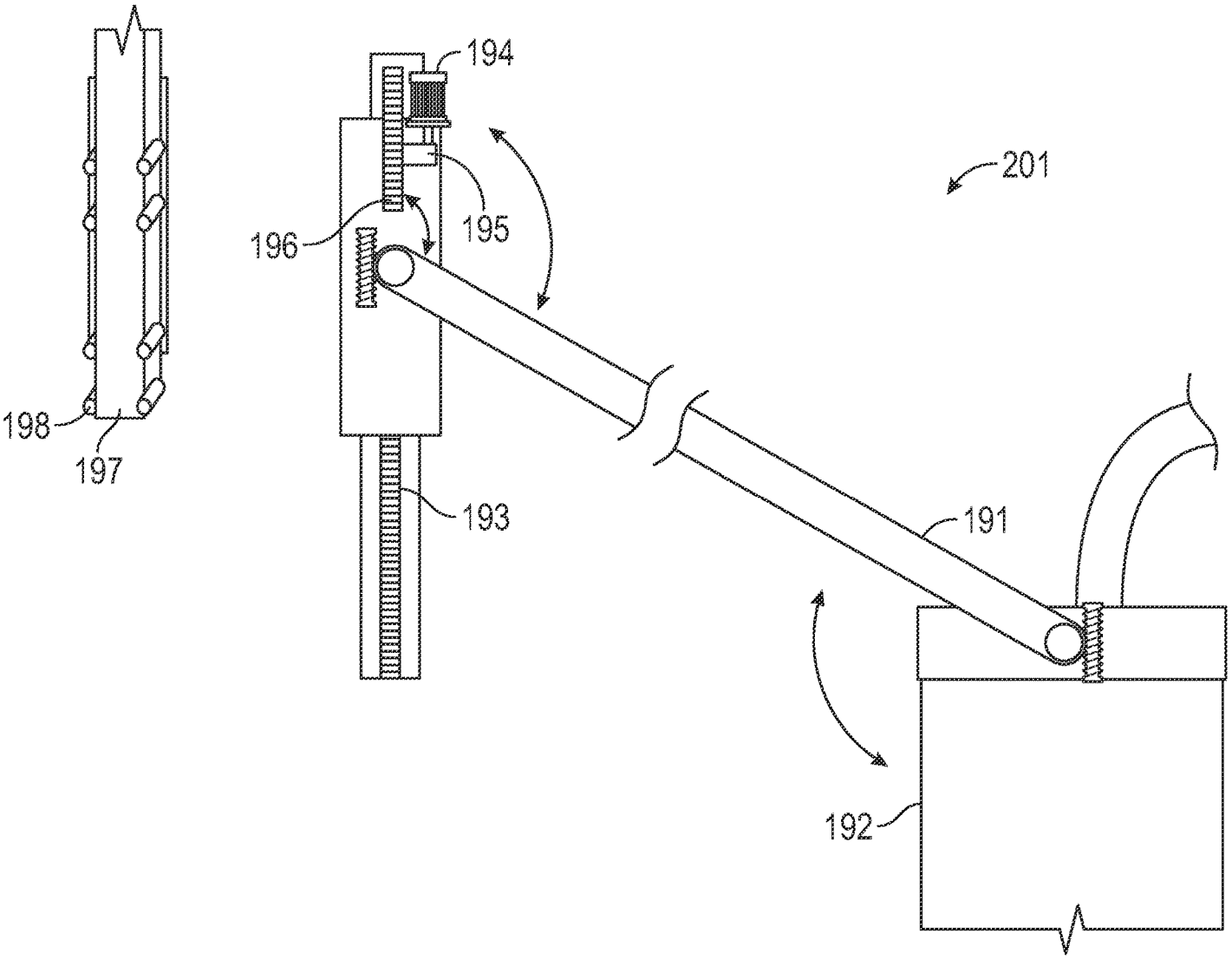
FIG. 19 shows an injector in accordance with the disclosure.

FIG. 19 shows an injection manipulating device 201 in accordance with the disclosure. FIG. 19 comprises an injector, an arm 191, worm gears 192, a rack 193, a motor 194, an axle drive 195, a pinion 196, structure legs 197, and a roller 198.

Figure 20:
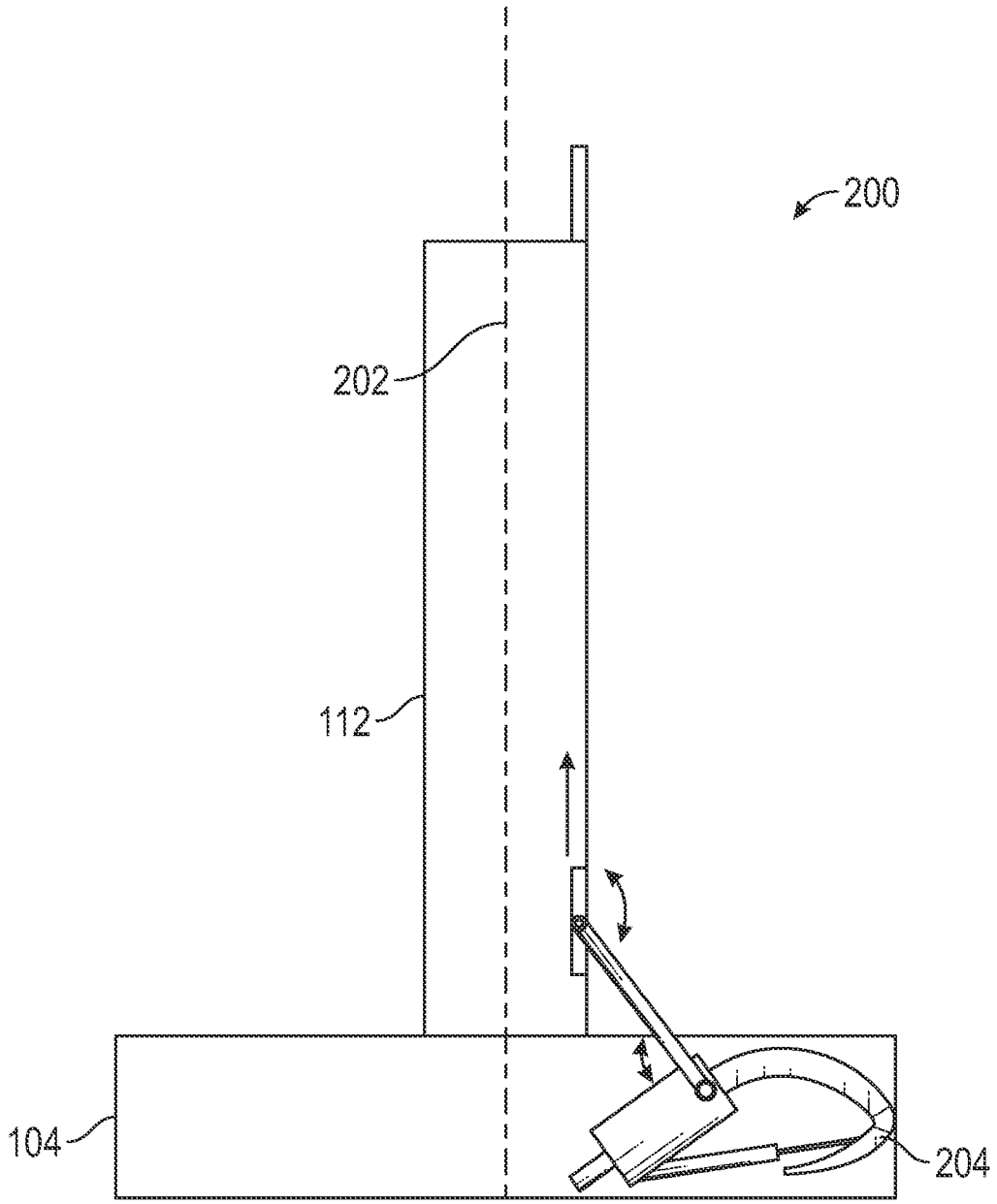
FIG. 20 shows a side view of a process of manipulating the injector.
Figure 21:
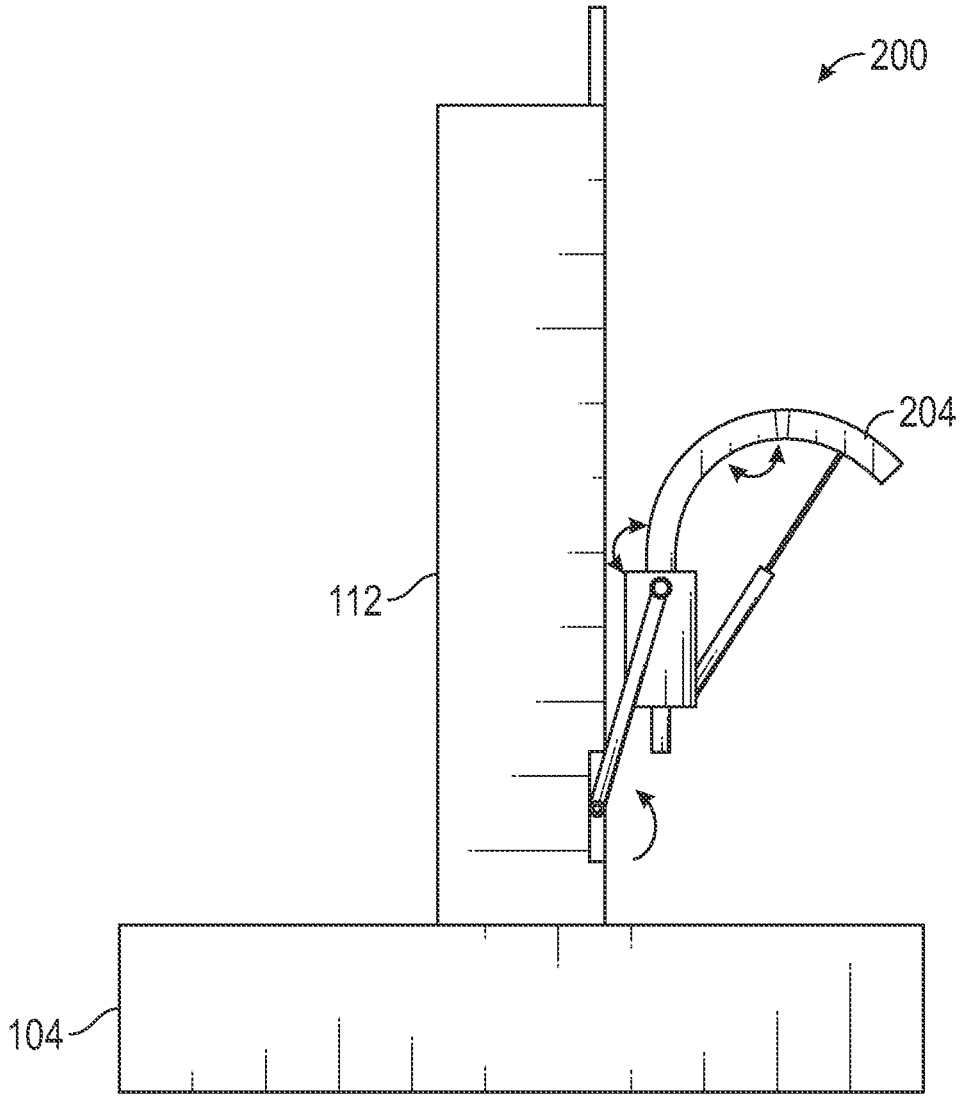
FIG. 21 shows a side view of a process of manipulating the injector.
Figure 22:
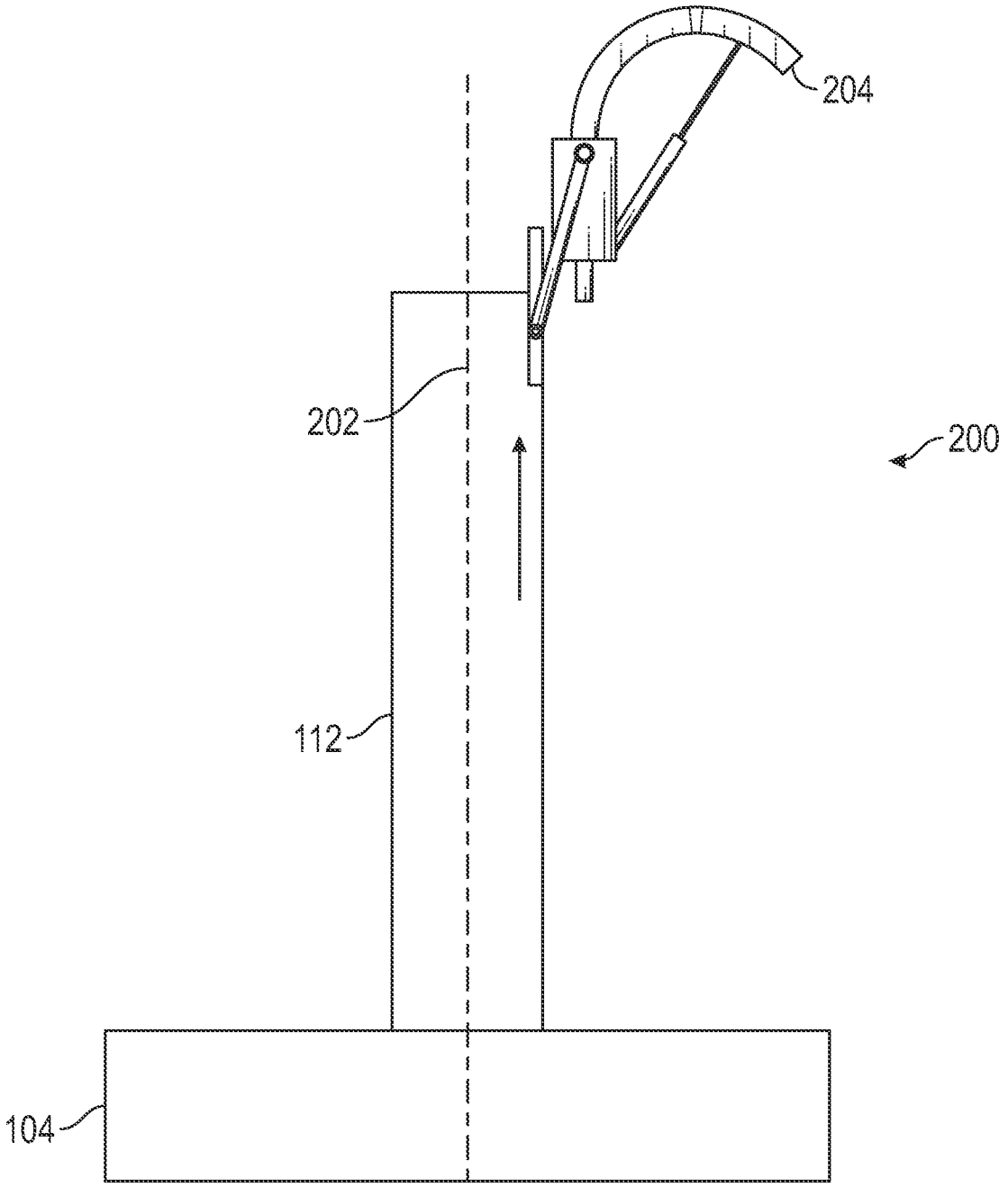
FIG. 22 shows a side view of a process of manipulating the injector.
Figure 23:
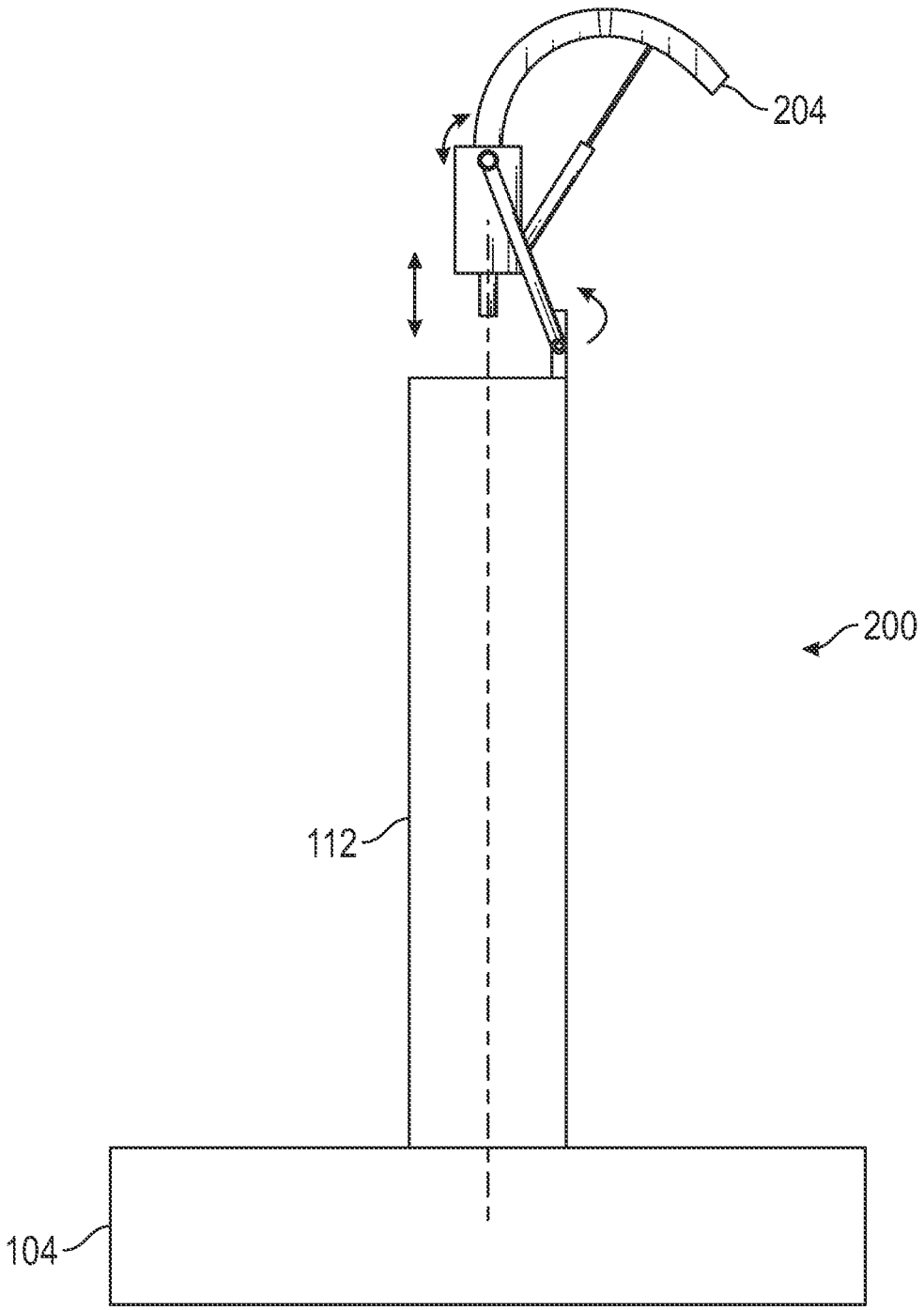
FIG. 23 shows a side view of a process of manipulating the injector.

FIGS. 20-23 shows a process of manipulating the injector. FIG. 20 shows a side view of an injector manipulation device 200 comprising a tower structure 112, hole center 202, injector 204, and a base structure 104. The injector 204 is in a stowed position. FIG. 21 shows a side view of an injector manipulation device 200 comprising a tower structure 112, injector 204, and a base structure 104. FIG. 22 shows a side view of an injector manipulation device 200 comprising a tower structure 112, hole center 202, injector 204, and a base structure 104. FIG. 23 shows a side view of an injector manipulation device 200 comprising a tower structure 112, hole center 202, injector 204, and a base structure 104. The tower sections are built with an assembly up the two front legs of the structure allowing an injector manipulating device to pick up, articulate, take the injector to the top or bottom as well as on and off hole. This allows the stabbing/replacement/repair and maintenance to be done to the injector at any time regardless of having a crane available. Conventional tower units have to use cranes for these functions which happen many times per hole.

Figure 24:
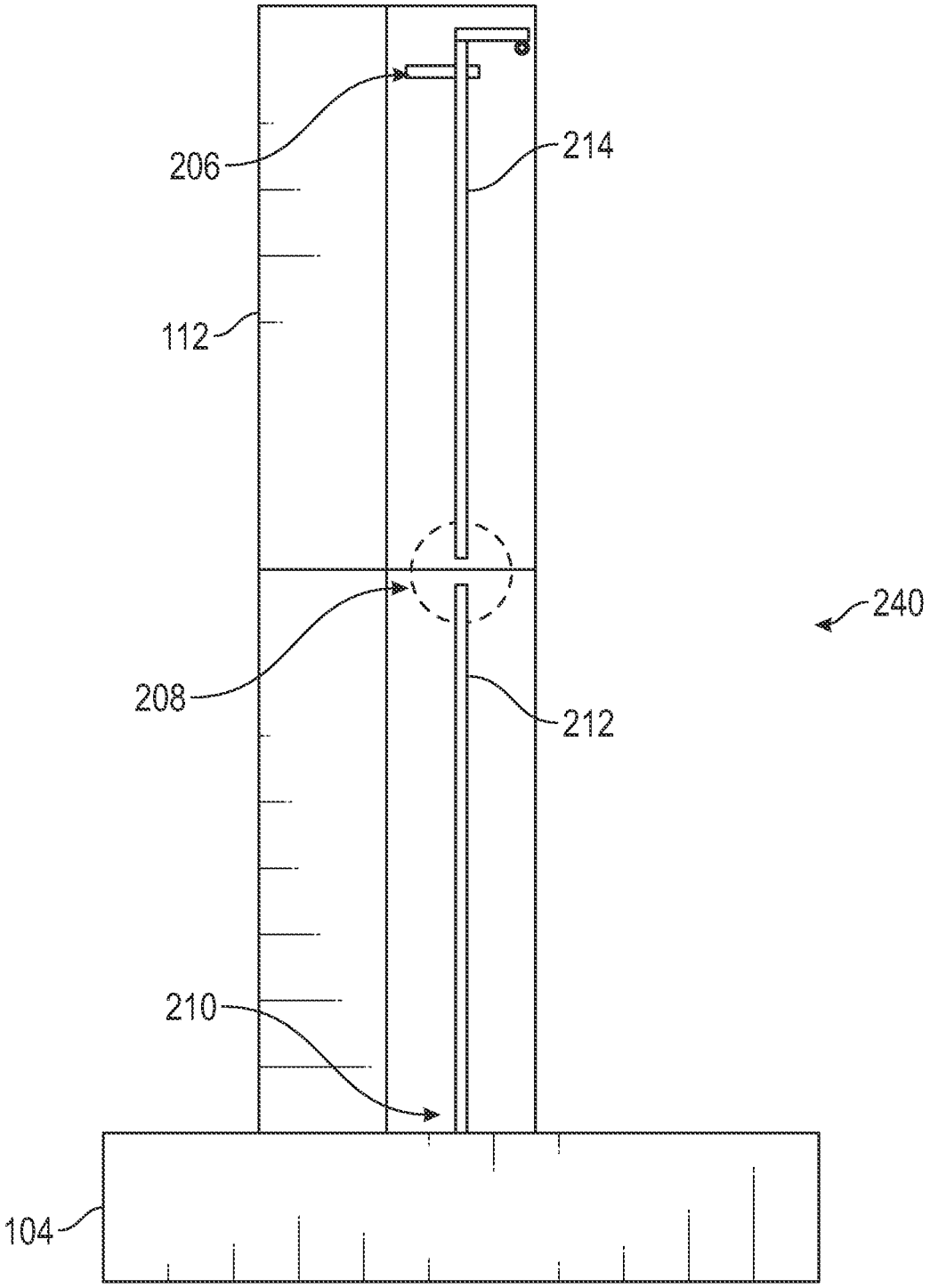
FIG. 24 shows a side view of a telescopic tool/equipment loading device on the tower.
Figure 25:
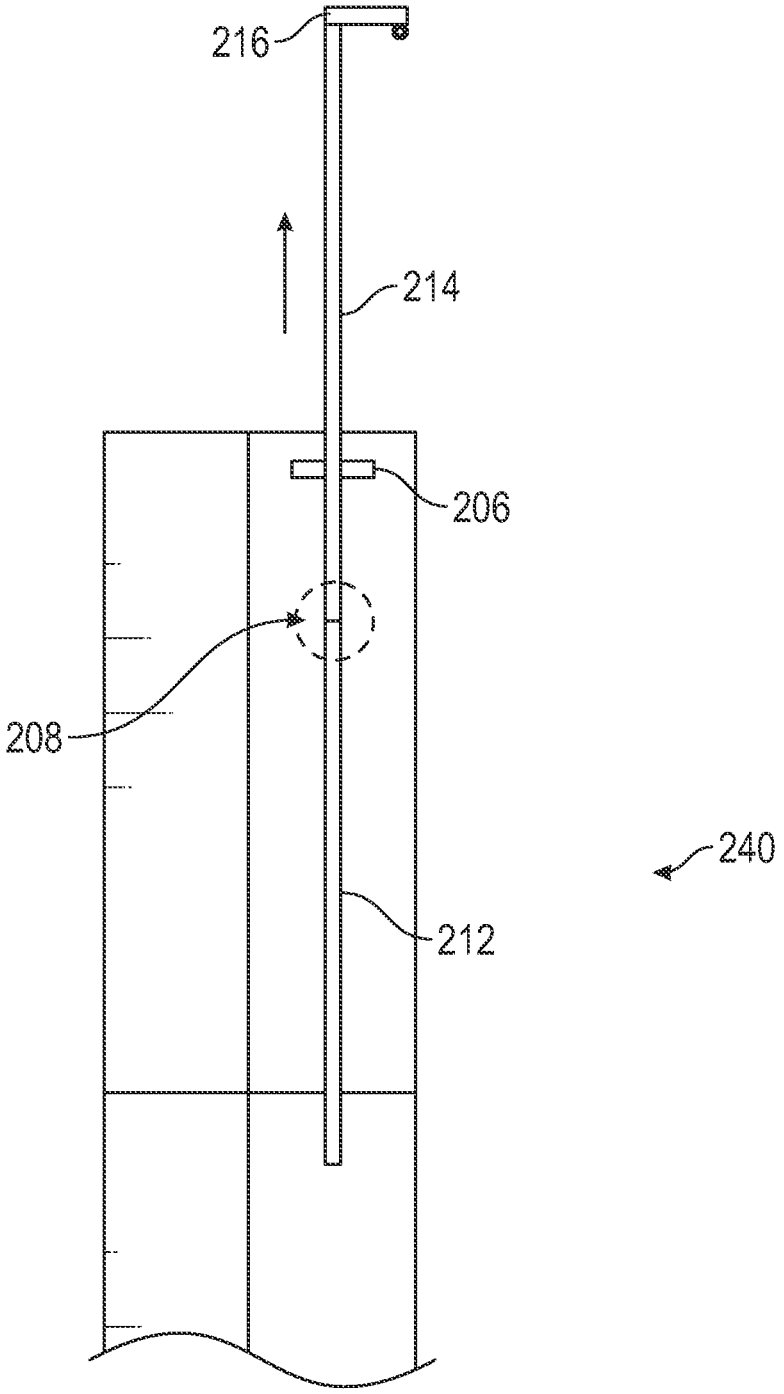
FIG. 25 shows a side view of a telescopic tool/equipment loading device on the tower.
Figure 26:
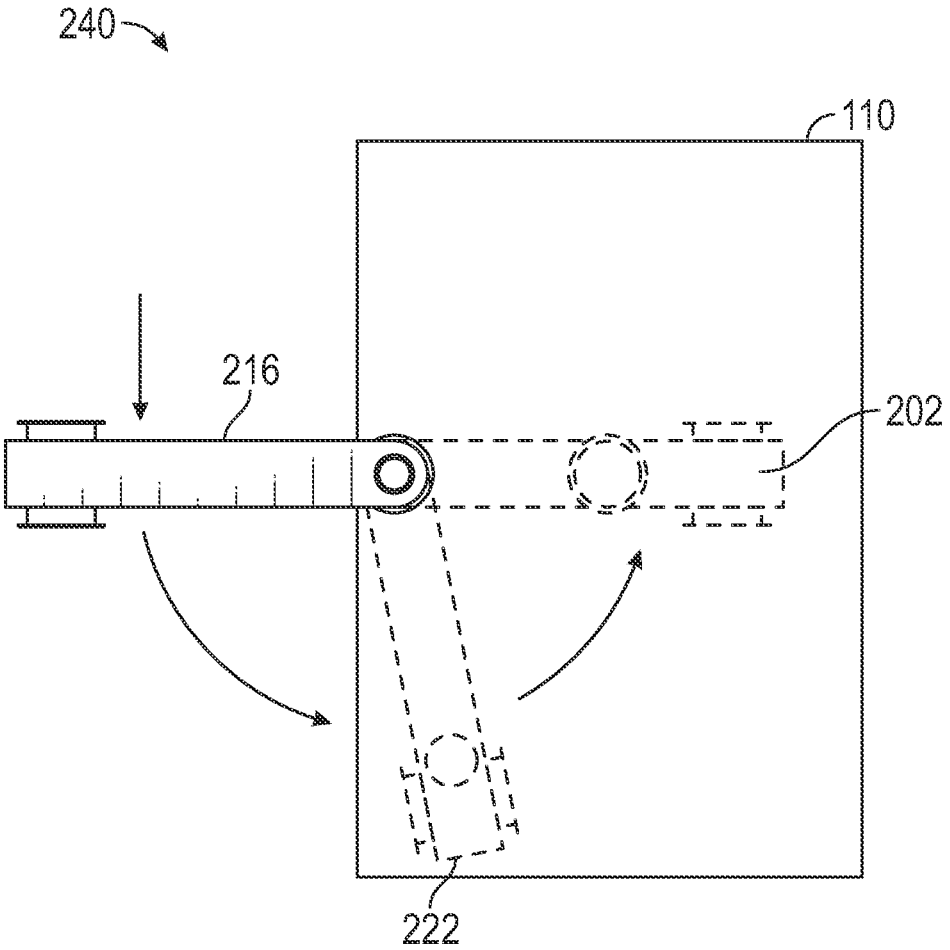
FIG. 26 shows a top view of a telescopic tool/equipment loading device on the tower.

FIGS. 24-26 show a telescoping tool or equipment loading device on the tower. FIG. 24 shows a side view of a telescoping tool 240 comprising sections 212 and 214, a connection point 208, a drive mechanism 206, and a base structure 104. The telescoping tool 240 is inside of the tower structure 112. FIG. 25 shows a side view of a telescoping tool 240 comprising sections 212 and 214, a connection point 208, and a drive mechanism 206. FIG. 26 shows a top view of the telescoping tool 240, comprising an arm 216 and a mouse hole 222. There is a hole center 202 present within the tower structure 112. The telescoping tool 240 emerges from inside of the tower structure 112. At the top of the tower structure 240 is the top section 212. The long tower sections allow for a telescoping hoisting structure to emerge from the sections with very little assembly since the two vertical sections already span 100'. This allows the unit to remove 100' BHAs (bottom hole assemblies) quick faster and cheaper than conventional units that require the rig in of a crane for this functionality. Once the two sections are attached and telescoped the device has the ability to move to multiple positions. In an embodiment, positions include, but are not limited to, "from the ground" position (which allows the unit to pick up or laydown tools to the ground), an "in and out of the mouse hole position" (which allows the unit to store extra tools in order to be quicker when it comes time to replace the tools), and a "over the hole" position (for the actual placement and removal of the tools to the well bore). These functions are done many times for a well, thus the efficiency of the disclosed devices and processes is apparent. Referring to FIGS. 24, 25, and 26, the long sections of the "equipment hoisting device", that enables an overall ability to pick up the top of a 100' BHA to heights enough to put them in the wellbore (200'+), can be assembled while maintaining transport "modularly" in the 50' sections. This is structurally sound for wind designed to API Specification 4f. These aspects, combined with the "mouse hole", having BHAs up in the tower and ready for deployment, cut the steps along the critical path of the process thus increasing the efficiency of the deployment process. In an embodiment, the process involved in moving a BHA from rest directly to hole center comprises hoisting the BHA up from a resting position, utilizing a drive mechanism and connected sections to place the BHA in the hole center. In an embodiment, the process involved in moving a BHA from storage in a mouse hole comprises hoisting the BHA up from a mouse hole and utilizing a drive mechanism and connected sections to place the BHA in the hole center. In an embodiment, the device is comprised of steel.

Figure 27:
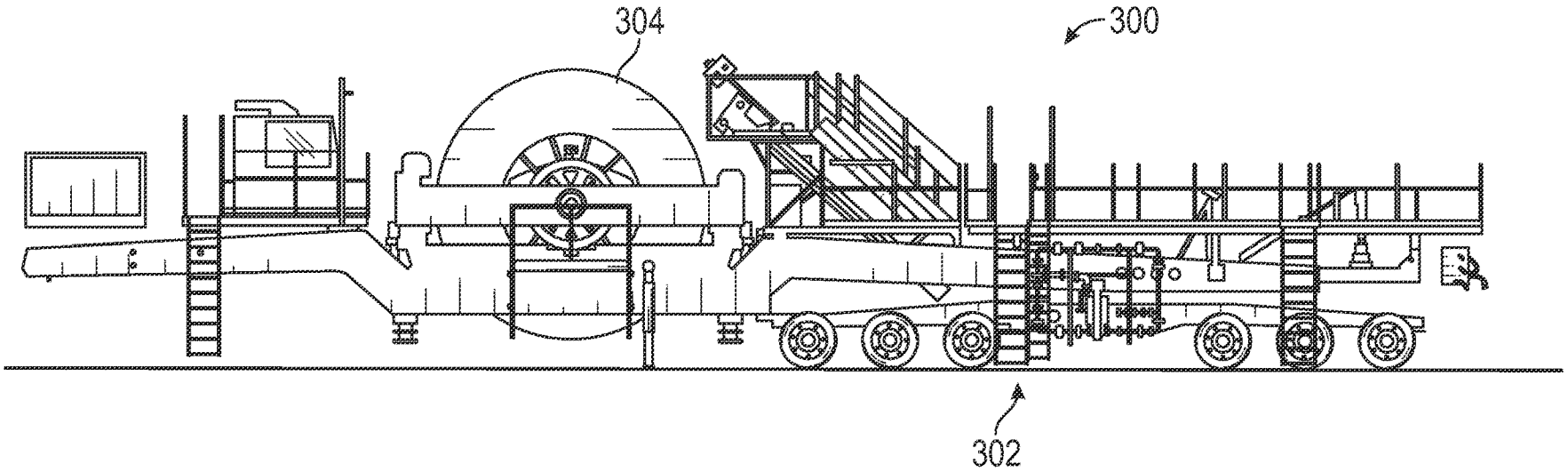
FIG. 27 shows a side view of a coil reel trailer with spool.
Figure 28:
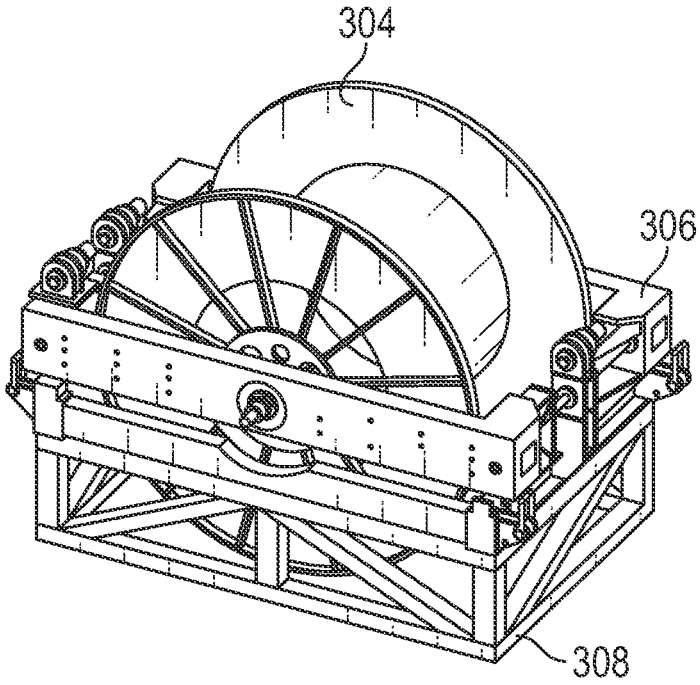
FIG. 28 shows a perspective view of a spool with cartridge and stand.
Figure 29:
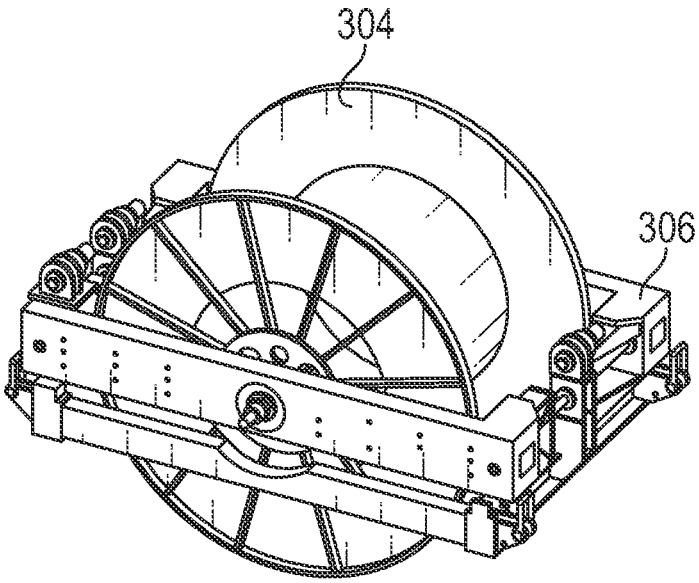
FIG. 29 shows a perspective view of a spool with cartridge.
Figure 30:
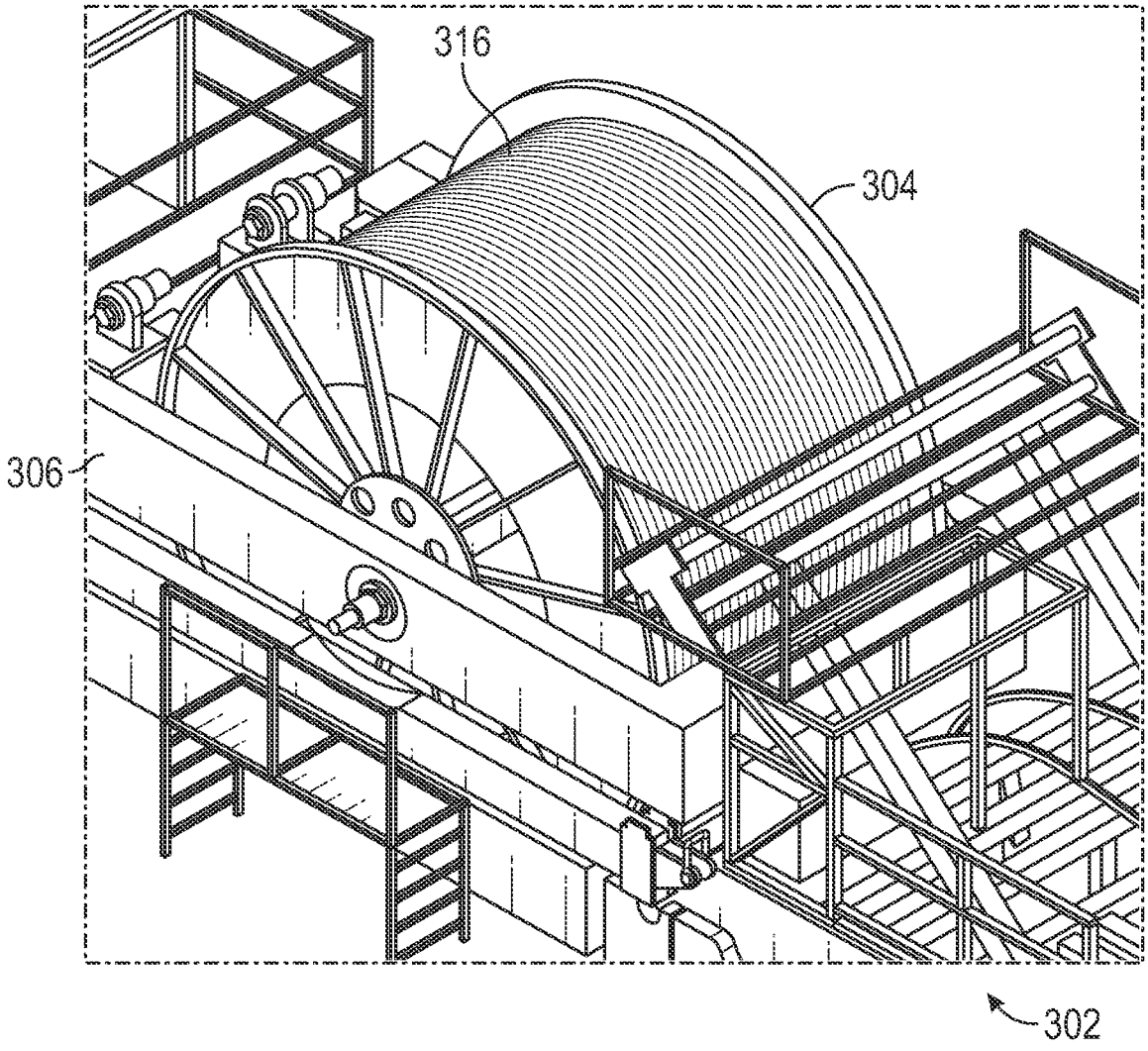
FIG. 30 shows a perspective view of a spool on a trailer.
Figure 31:
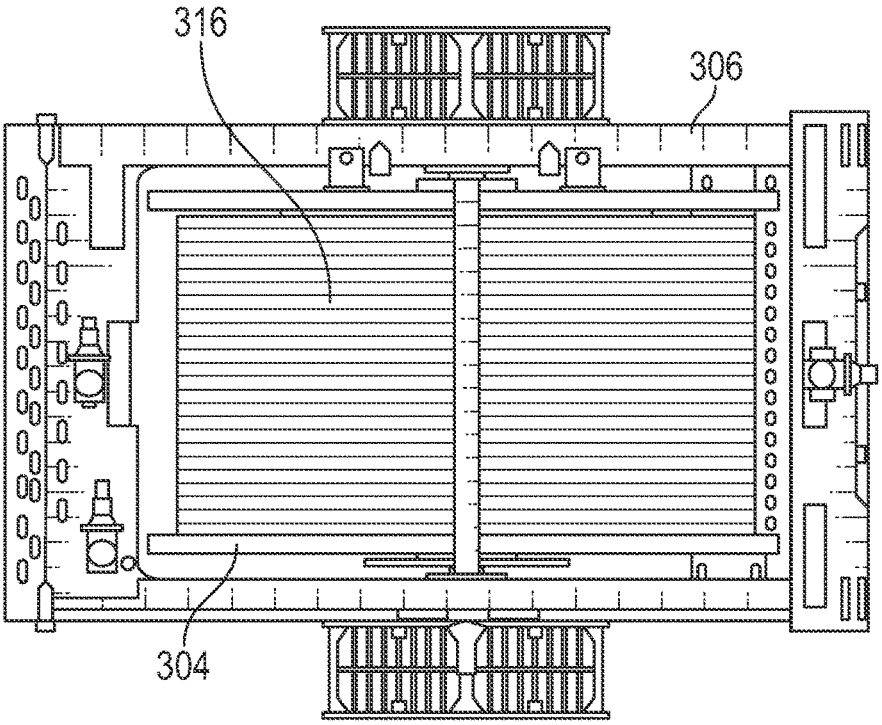
FIG. 31 shows a top view of a spool with cartridge.
Figure 32:
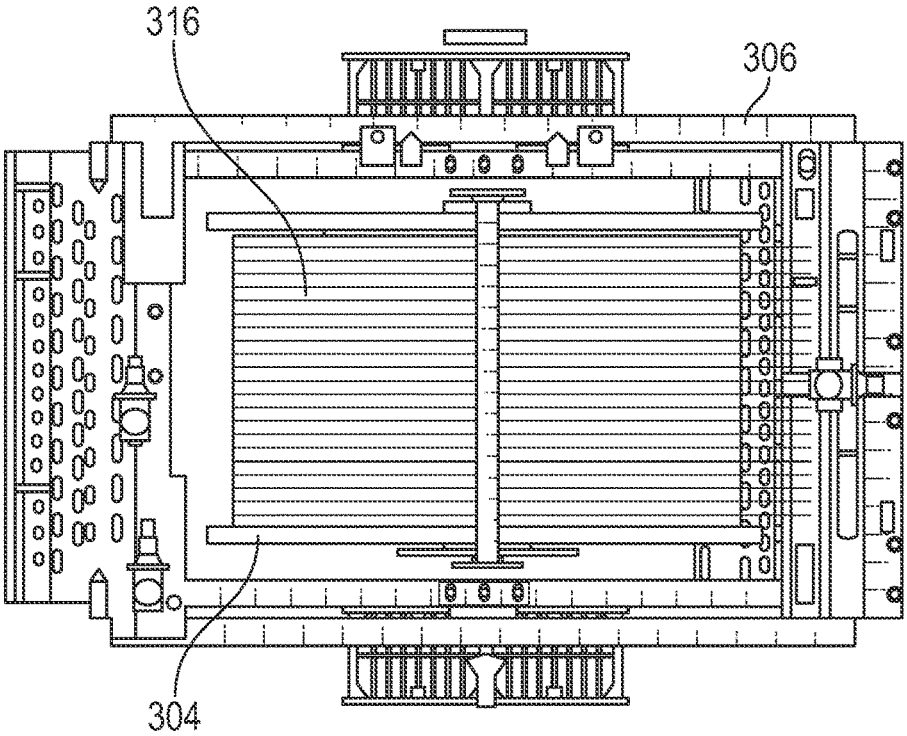
FIG. 32 shows a top view of a spool with cartridge.
Figure 33:
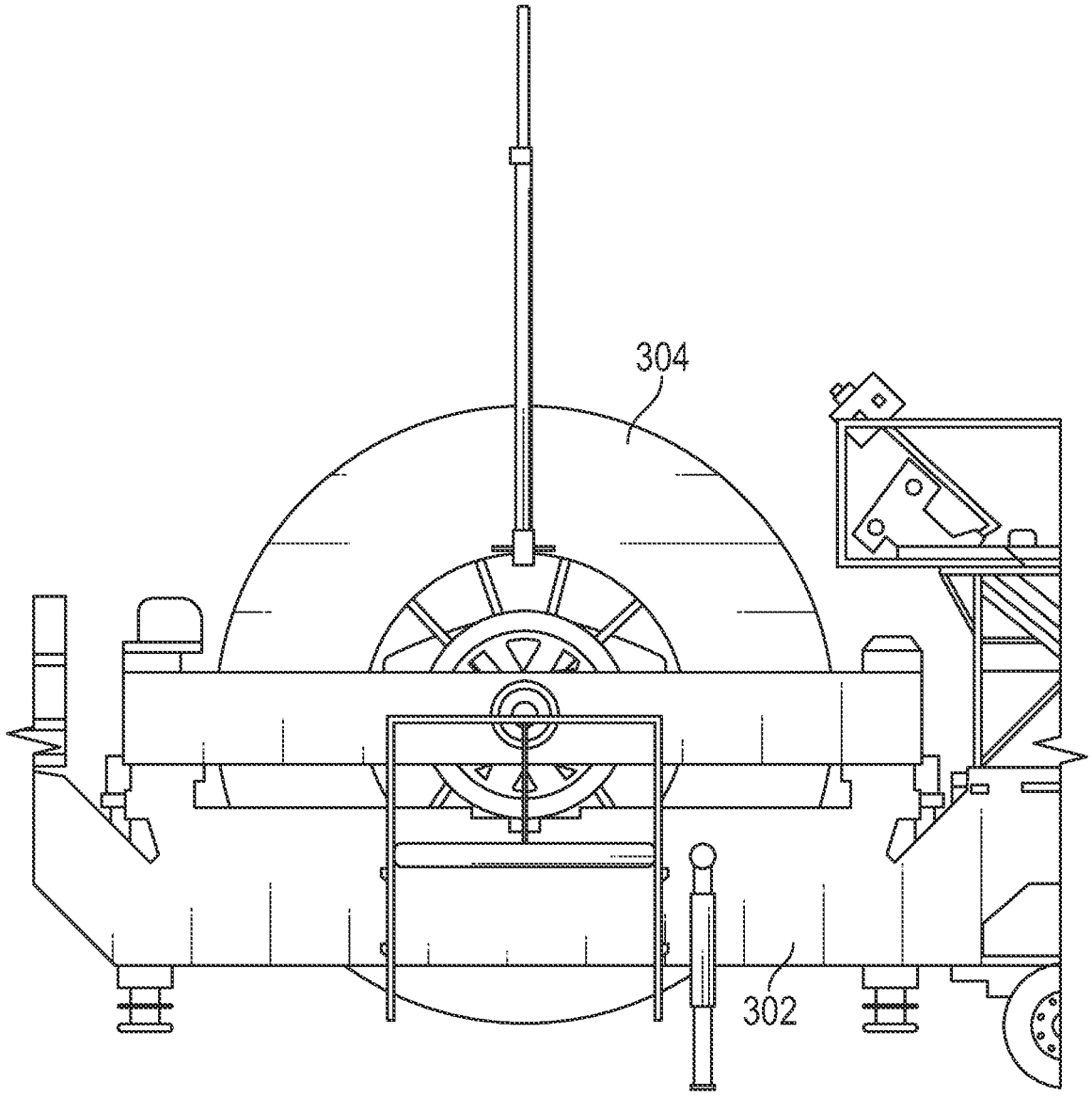
FIG. 33 shows a side view of a spool on a trailer.
Figure 34:
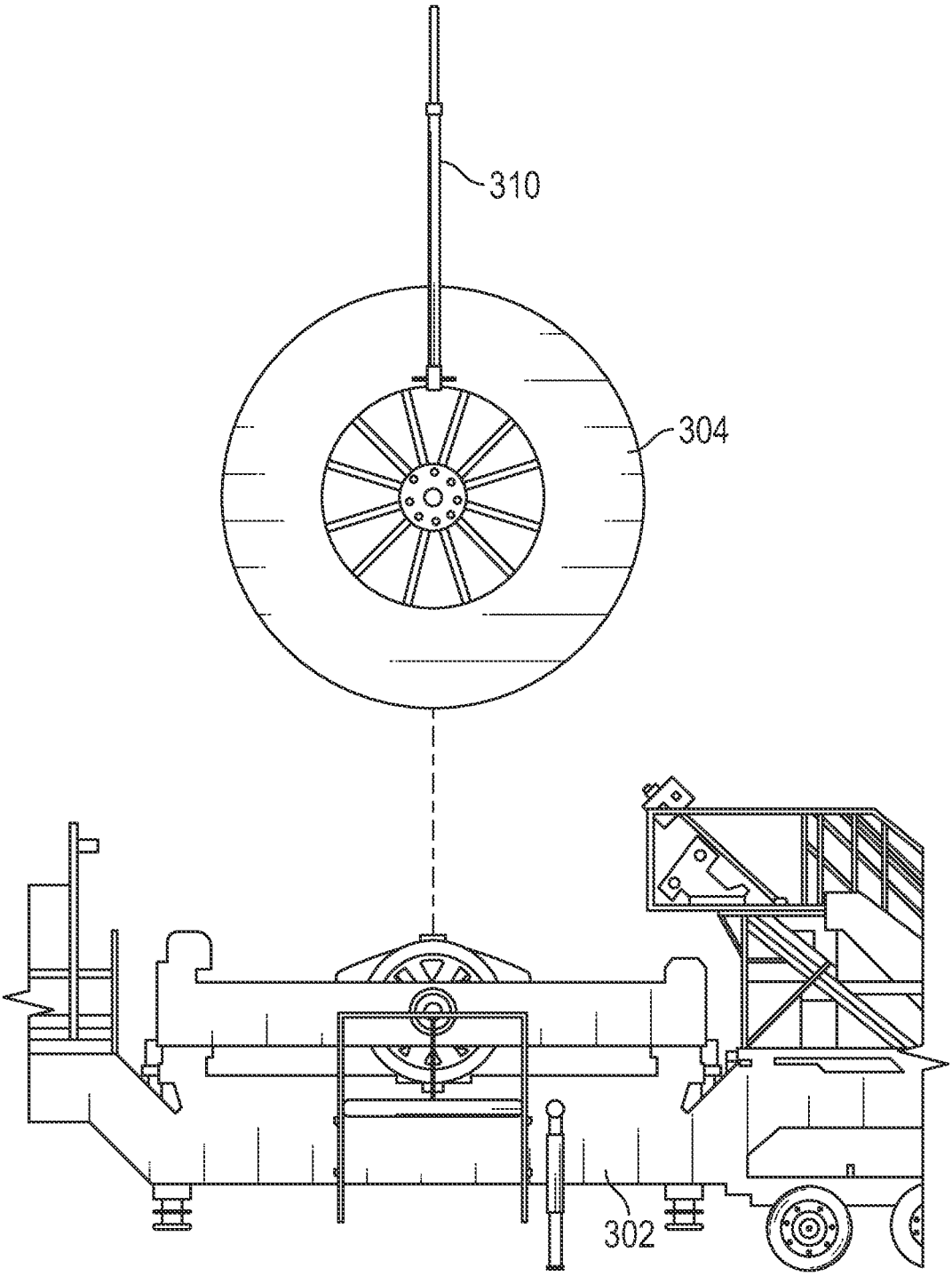
FIG. 34 shows a side view of a spool being loaded on the trailer using a holding mechanism.
Figure 35:
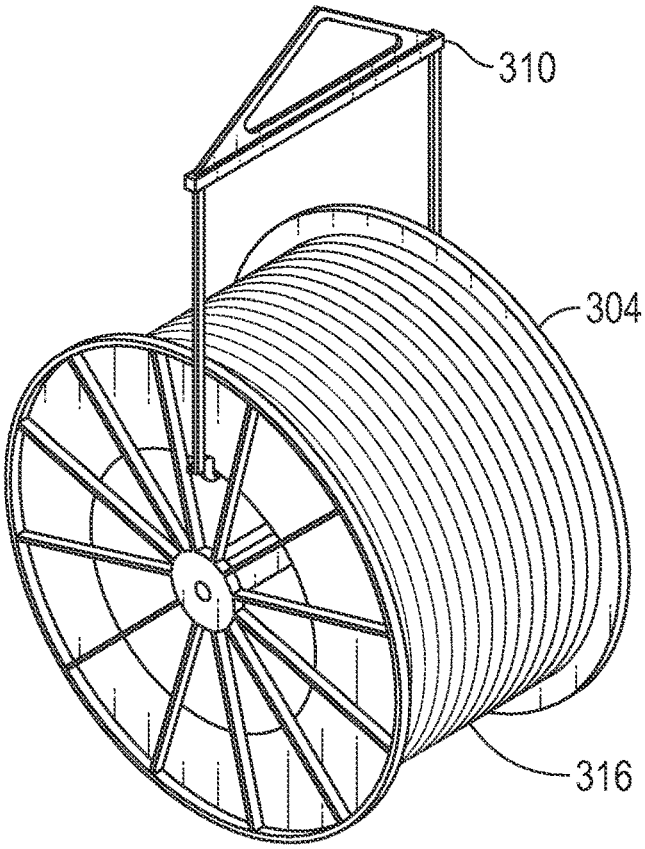
FIG. 35 shows a perspective view of a spool attached to a holding mechanism.
Figure 36:
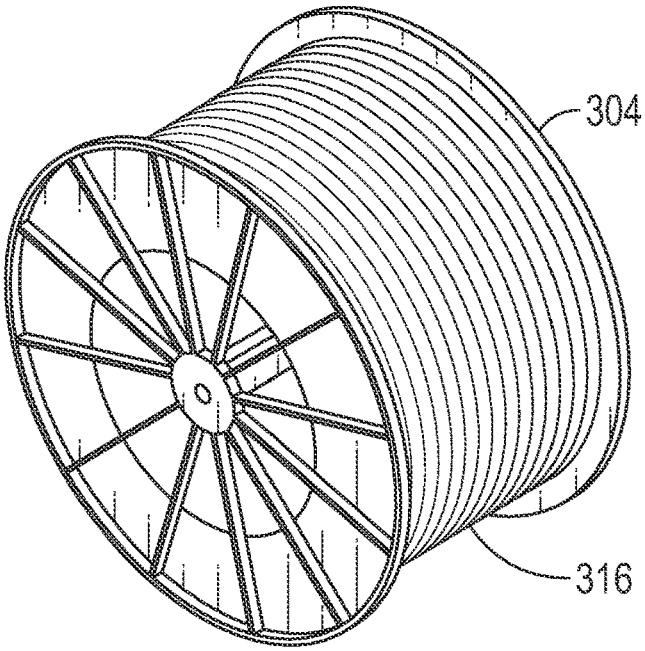
FIG. 36 shows a perspective view of a spool.
Figure 37:
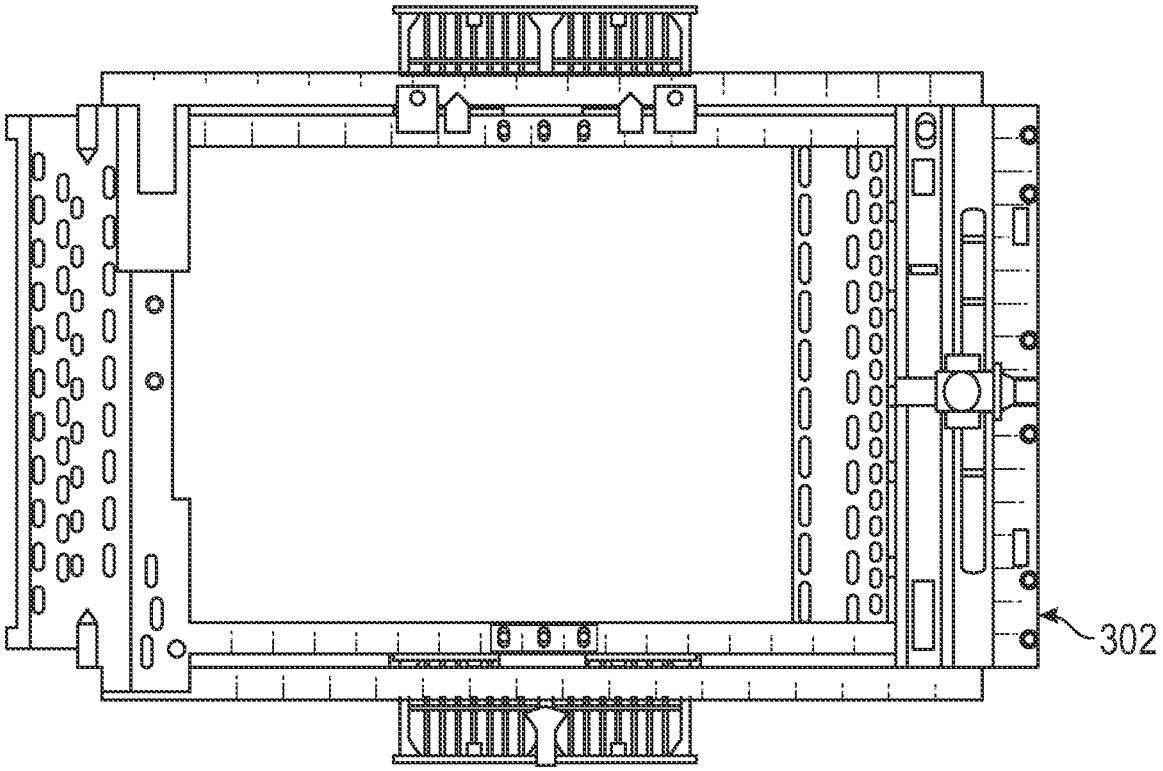
FIG. 37 shows a top view of a cartridge on a trailer.
Figure 38:
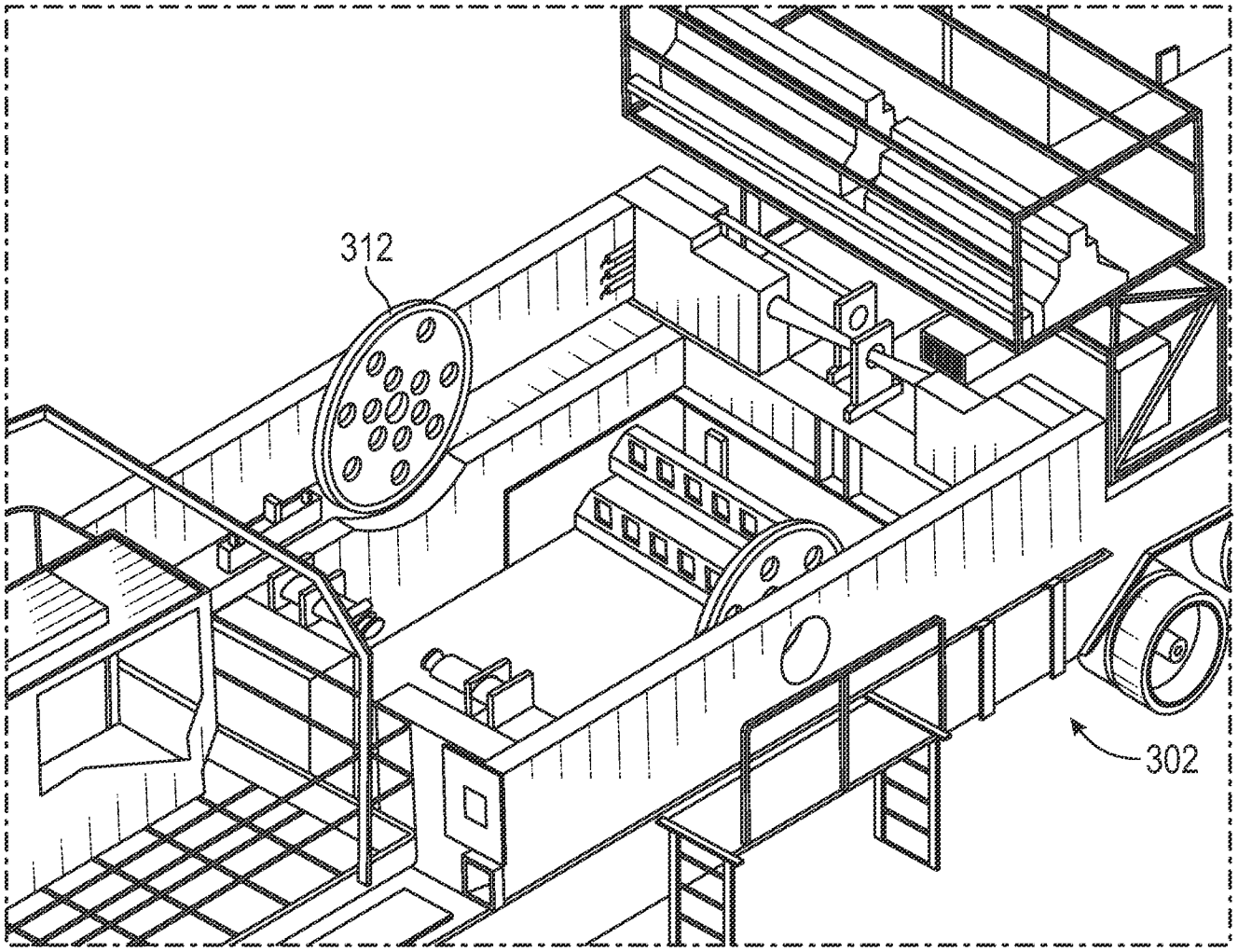
FIG. 38 shows a perspective view of an interface for the spool on a trailer.
Figure 39:
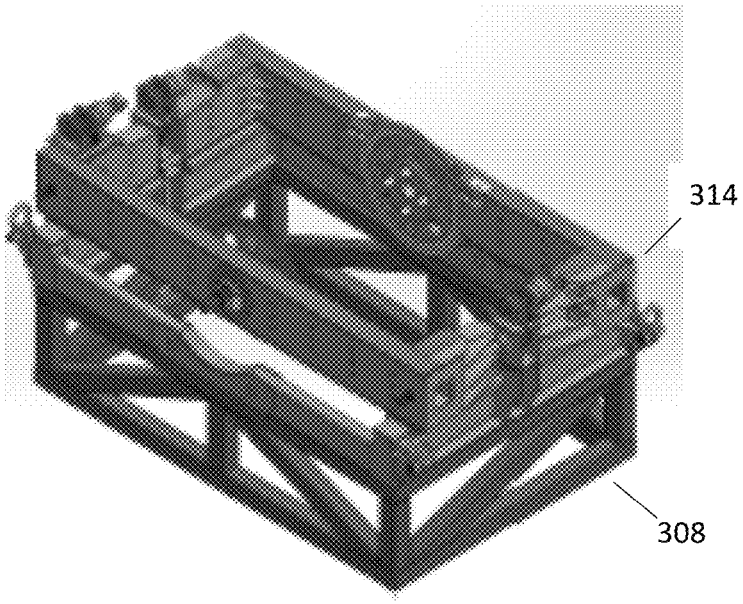
FIG. 39 shows a perspective view of a cartridge and a stand.
Figure 40:
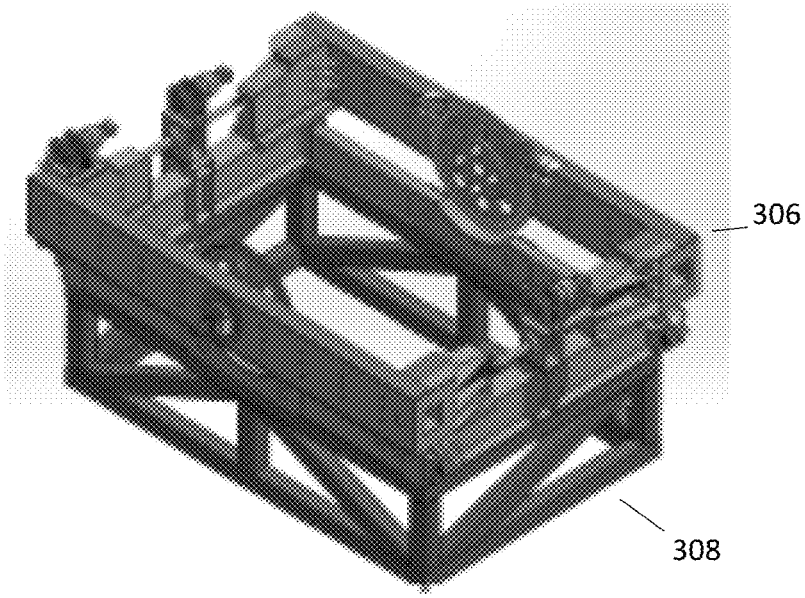
FIG. 40 shows a perspective view of a cartridge and a stand.
Figure 41:
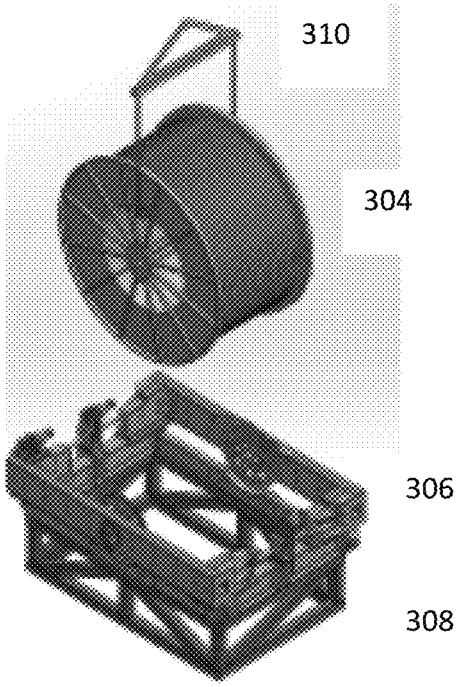
FIG. 41 shows a perspective view of a spool being lowered into a cartridge and stand.
Figure 42:
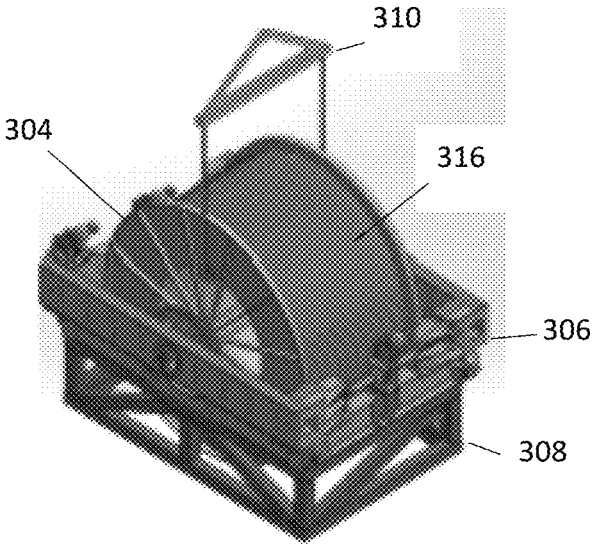
FIG. 42 shows a perspective view of a spool being lowered into a cartridge and stand.
Figure 43:
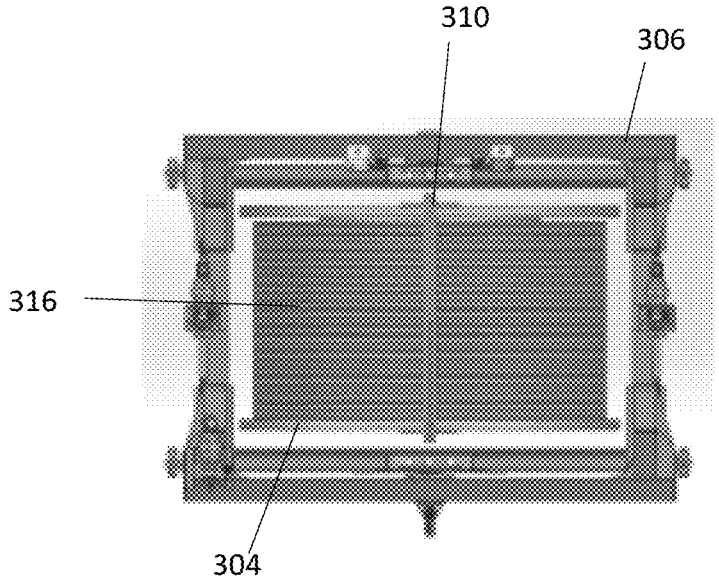
FIG. 43 shows a top view of a spool in a cartridge.
Figure 44:
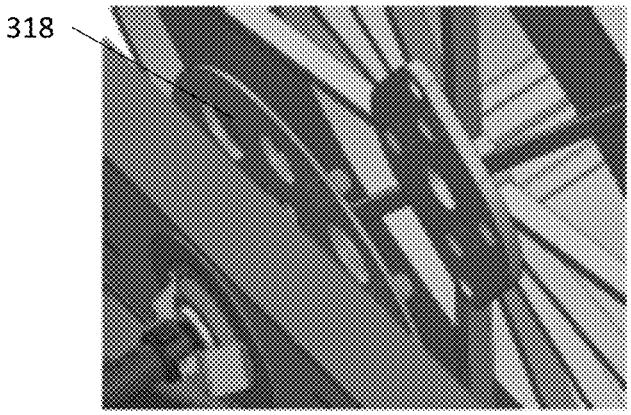
FIG. 44 shows a perspective view of a spool and cartridge.
Figure 45:
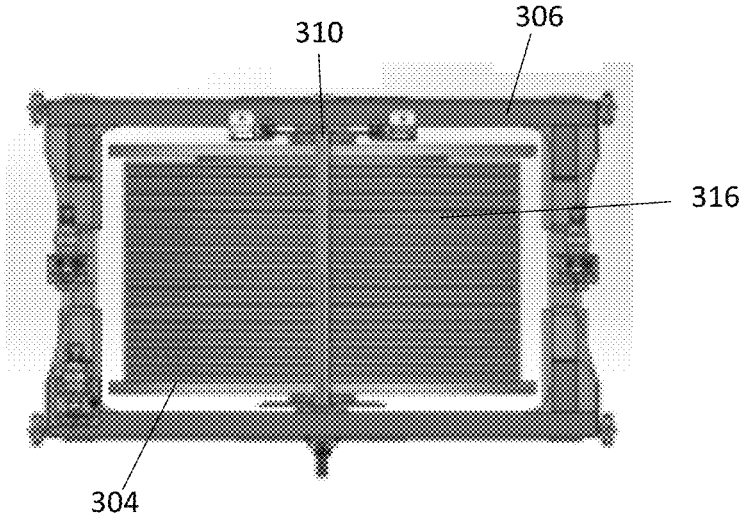
FIG. 45 shows a perspective view of a spool and cartridge.
Figure 46:
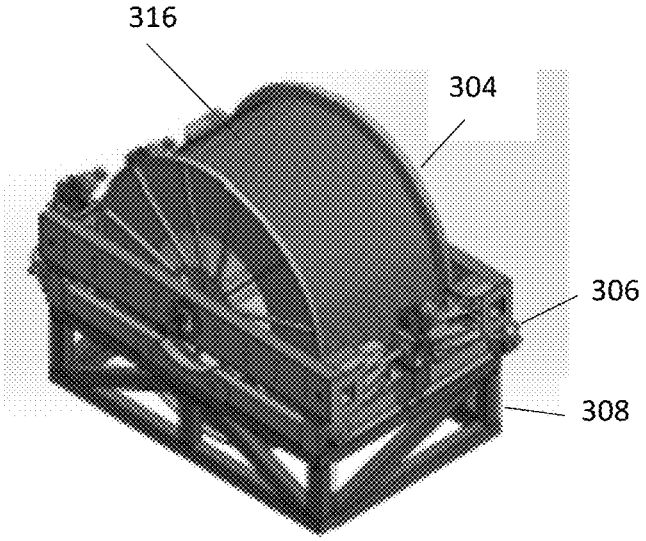
FIG. 46 shows a perspective view of a spool, cartridge, and a stand.

In an embodiment, the rig has a unique "work reel utilizing cartridge system". (FIGS. 27-46). Other coil units have "drop in" systems which consist of specifically designed and fabricated reels that can be loaded with tubing then "installed" into the rig itself or they have specific built reels and drive systems than can be dropped into the unit and utilized. In an embodiment, the present disclosure includes a cartridge style reel system that utilizes "shipping reels". The benefits of the "combo" design is the advantages of both systems and the ability to use off-the-shelf "shipping spools". This is particularly advantageous for jobs done internationally since most coil is manufactured in the United States and shipped on "shipping spools". In an embodiment, the advantages of the present disclosure include time savings due to the installation of the shipping reel and associated equipment being possible proactively outside the coil input itself in its "cartridge holder" state, further time is saved with the installation of the cartridge itself due to it being "ready to go". This saves money and complexity for the customer due to the coil not needing to be "respooled and such because the "shipping spool" is what it directly installed into the cartridge and, in turn, into the rig. In an embodiment, the spool is comprised of steel. In an embodiment, the rig is comprised of steel. [0075] Referring to FIGS. 27-46, not only can the device contain and use a "shipping reel" as a "working reel" on the rig itself, but the unit can also be installed, utilized, and operated in a stand offline. This way the reel and device can then be proactively wired, plumbed, prepared for insertion, and shipped to the rig and simply dropped in like a cartridge, ready to operate with a few minor hydraulic connections. This allows the time to changeover reels to go from many hours to minutes. FIG. 27 shows a side view of a coil reel trailer 300 comprising a reel/spool 304 and a trailer 302. FIG. 28 shows a perspective view of a reel 304 present in a cartridge 306 and stand 308. FIG. 29 shows a perspective drawing of a reel 304 in a cartridge 306. FIG. 30 shows a perspective view of coiled tubing 316, present on a reel 304. The reel 304 in present in a cartridge 306 on a trailer 302. FIG. 31 shows a top view of coiled tubing 316, present on a reel 304. The reel is on a cartridge 306. FIG. 32 shows a top view of coiled tubing 316, present on a reel 304. The reel is on a cartridge 306. FIG. 33 shows a side view of a reel 304 on a trailer 302. FIG. 34 shows a side view of a reel 304 being lowered onto a trailer 302 with a holding mechanism 310. FIG. 35 shows a perspective view of a reel 304 of coiled tubing 316 on a holding mechanism 310. FIG. 36 shows a perspective view of a reel 304 of coiled tubing 316. FIG. 37 shows a top view of a trailer 302. FIG. 38 shows a perspective view of a trailer 302 with an interface 312. FIG. 39 shows a perspective view of a cartridge 314 on a stand 308. FIG. 40 shows a perspective view of a cartridge 306 on a stand 308. FIG. 41 shows a perspective view of a reel 304 of coiled tubing 316 on a holding mechanism 310 being lowered into a cartridge 306 on a stand 308. FIG. 42 shows a perspective view of a reel 304 of coiled tubing 316 on a holding mechanism 310 lowered into a cartridge 306 on a stand 308. FIG. 43 shows a top view of a reel 304 of coiled tubing 316 on a holding mechanism 310 lowered into a cartridge 306. FIG. 44 shows a perspective view of an interface 318. FIG. 45 shows a top view of a reel 304 of coiled tubing 316 on a holding mechanism 310 lowered into a cartridge 306. FIG. 46 shows a perspective view of a reel 304 of coiled tubing 316 in a cartridge 306 on a stand 308. [0076] All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit, and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. A coil tubing tower structure, comprising a base;

a tower structure; and a telescoping hoisting structure, wherein the tower structure comprises a plurality of intermediate units;

the length of each of the plurality of intermediate units is fifty feet; and wherein the telescoping hoisting structure is located inside the tower structure and can hoist above the tower structure.

2. The structure of claim 1, wherein a well control equipment is secured at the top of each intermediate unit.

3. The structure of claim 1, further comprising an injector.

4. The structure of claim 3, wherein the injector is operated by an injector manipulating device.

5. The structure of claim 4, wherein the injector manipulating device has an ability to pick up, articulate, move the injector.

6. The structure of claim 1, wherein the telescoping hoisting structure has an ability to move to multiple positions.

7. A process of using a coil tubing tower structure of claim 1, comprising using the telescoping hoisting structure to pick up a bottom hole assembly using one or more sections to a height suitable to place the bottom hole assembly in a wellbore, wherein transport modularly remains in the sections, and wherein the sections are fifty feet in height.

8. The process of claim 7 wherein the height suitable to place the bottom hole assembly in a wellbore is at least two hundred feet.

9. The process of claim 7 wherein the bottom hole assembly is about one hundred feet in height.

10. The process of claim 7 wherein the telescoping hoisting structure stores the bottom hole assembly in a mouse hole.

* * * * *